US012571225B2

(12) United States Patent
Matsuda

(10) Patent No.: US 12,571,225 B2
(45) Date of Patent: Mar. 10, 2026

(54) MOVABLE STANDS

(71) Applicant: KOTOBUKI SEATING CO., LTD., Tokyo (JP)

(72) Inventor: Munekazu Matsuda, Tokyo (JP)

(73) Assignee: KOTOBUKI SEATING CO., LTD., Tokyo (JP)

( * ) Notice: Subject to any disclaimer, the term of this patent is extended or adjusted under 35 U.S.C. 154(b) by 192 days.

(21) Appl. No.: 18/687,914

(22) PCT Filed: Sep. 3, 2021

(86) PCT No.: PCT/JP2021/032488
§ 371 (c)(1),
(2) Date: Mar. 21, 2024

(87) PCT Pub. No.: WO2023/032167
PCT Pub. Date: Mar. 9, 2023

(65) Prior Publication Data

US 2024/0426120 A1 Dec. 26, 2024

(51) Int. Cl.
*E04H 3/12* (2006.01)

(52) U.S. Cl.
CPC ..... *E04H 3/12* (2013.01)

(58) Field of Classification Search
CPC ..... E04H 3/12; E04H 3/123; E04H 3/126
See application file for complete search history.

(56) References Cited

U.S. PATENT DOCUMENTS 6,539,672 B1 * 4/2003 Frost ..... E04H 3/123 52/9
2008/0190038 A1 * 8/2008 Jacobs ..... E04H 3/123 52/9

(Continued)

FOREIGN PATENT DOCUMENTS

JP S62-054153 U 4/1987
JP S62-126454 U 8/1987

(Continued)

OTHER PUBLICATIONS

International Search Report mailed Nov. 16, 2021 for PCT/JP2021/032488.

(Continued)

*Primary Examiner* — Theodore V Adamos
(74) *Attorney, Agent, or Firm* — Faegre Drinker Biddle & Reath LLP

(57) ABSTRACT

Movable stands include a plurality of floor stands, and a plurality of leg parts. The leg parts include a first stopper that allows the floor stand and the floor stand one step below to move forward in conjunction with each other to a state of being deviated in a stepped form, and a second stopper that allows the floor stands of the set to move forward in conjunction while being aligned in an up and down direction. The movable stands include a mode switching unit that switches the second stopper between a protruded state and a retracted state, and a switching drive unit. In the storage position, a plurality of sets of mode switching units are integrally driven in conjunction with driving of the switching drive unit to switch the plurality of sets of second stoppers between the protruded state and the retracted state.

15 Claims, 13 Drawing Sheets

(56) References Cited

U.S. PATENT DOCUMENTS

| | | | | |
|---|---|---|---|---|
| 2011/0099915 | A1* | 5/2011 | Sudkamp | E04H 3/123 52/9 |
| 2012/0144757 | A1 | 6/2012 | Hockemeyer | |
| 2014/0069026 | A1* | 3/2014 | Parker | E04H 3/123 52/741.1 |

FOREIGN PATENT DOCUMENTS

| | | | | |
|---|---|---|---|---|
| JP | H01-076955 | U | 5/1989 | |
| JP | H04-024959 | U | 2/1992 | |
| WO | WO-2014041348 | A1 * | 3/2014 | E04H 3/123 |
| WO | WO-2015181871 | A1 * | 12/2015 | E04H 3/12 |
| WO | WO-2016139792 | A1 * | 9/2016 | E04H 3/12 |
| WO | WO-2022059131 | A1 * | 3/2022 | E04H 3/12 |

OTHER PUBLICATIONS

Written Opinion of the International Searching Authority mailed Nov. 16, 2021 for PCT/JP2021/032488.

* cited by examiner

MOVABLE STANDS

TECHNICAL FIELD

The present disclosure relates to movable stands.

BACKGROUND ART

In the related art, movable stands are known that can be moved back and forth in conjunction with each other between a use position where a plurality of floor stands are expanded to a stepped form and a storage position where the floor stands are generally aligned in up and down direction.

The movable stands disclosed in Patent Literature 1 include a plurality of floor stands, connected chairs that are mounted on each floor stand and that include a plurality of chairs connected side by side, and leg parts that movably support each floor stand in front and back direction in a horizontal state and engage and move the floor stands in conjunction with each other.

The movable stands disclosed in Patent Literature 1 are provided with an inverted L-angle shaped stopper at the front end of a base of each leg part coupled to the floor stand other than the lowermost floor stand, and engage the stopper with a support column coupled to the floor stand one step below to move in conjunction with each other, and are expanded to a normal use position in which the floor stands are expanded to a stepped form one step at a time.

In the movable stands disclosed in Patent Literature 1, the attachment position of the stopper to the base may be changed. By changing the engagement position between the stopper and the support column, it is configured to expand to a shortened use position where the length in the front and back direction is shortened, with some of the plurality of floor stands being aligned in the up and down direction.

CITATION LIST

Patent Literature

Patent Literature 1: WO2016/139792A

SUMMARY OF INVENTION

Technical Problem

However, in the movable stands of Patent Literature 1, there is a problem in that it is necessary to individually change the mounting position of the stopper while the stopper is stored in the storage position to switch between a normal use position mode in which the stands are expanded to the normal use position and a shortened use position mode in which the stands are expanded to the shortened use position, which makes the operation complicated.

The present disclosure has been made in view of the circumstances described above, and an object of the present disclosure is to provide movable stands capable of integrally switching between a mode of expanding to a normal use position and a mode of expanding to a shortened use position with a simple operation.

Solution to Problem

To achieve the object described above, one aspect of the present disclosure provides movable stands including a plurality of floor stands; and a plurality of leg parts each horizontally supporting the floor stands and movable in a front and back direction, in which the leg part includes a first stopper engaged with the leg part of the floor stand that is one step below the floor stand supported by the leg part, and that allows the floor stand and the floor stand one step below to move forward in conjunction with each other to a state of being deviated in a stepped form, and a second stopper provided on the leg part of a first floor stand of a set of floor stands that includes some of the plurality of floor stands, configured to protrude toward and retracted from the leg parts of the other floor stands of the set, and engaged with the leg parts of the other floor stands to allow the floor stands of the set to move forward in conjunction while being aligned in an up and down direction, the movable stands are movable between a storage position where the floor stands are aligned in the up and down direction as a whole and a normal use position where the floor stands are expanded to a stepped form one step at a time or a shortened use position where the set of floor stands is expanded to the stepped form, the movable stands include a plurality of sets of the floor stands, in each set, the leg parts of the first floor stand are provided with a mode switching unit that includes the second stopper and a switching lever that protrudes behind the leg parts of the first floor stand and switches the second stopper between a protruded state and a retracted state, the movable stands further include a switching drive unit fixed behind the leg parts of the plurality of floor stands aligned in a left and right direction at the storage position, and the switching drive unit is provided with a movable part that is engaged with a plurality of sets of the switching levers in the storage position, and that is configured to integrally drive a plurality of sets of the switching levers in conjunction with the driving of the movable part to switch a plurality of sets of the second stoppers between the protruded state and the retracted state.

For convenience of understanding, the movable stands according to the aspects described above will be described according to the embodiments shown in FIGS. 1A to 9B. Some of a plurality of floor stands, that is, adjacent even-numbered floor stands 10 and adjacent odd-numbered floor stands 10 form sets of floor stands. A first floor stand in the set (that is, one of the floor stands 10 of the set), that is, the even-numbered floor stand 10 is provided with, on a leg part 30 (that is, on a base $\mathbf{32}_e$ thereof), a mode switching unit 50 including a second stopper 52 and a switching lever 55 for switching between a protruded state and a retracted state of the second stopper 52. The second stopper 52 is engaged with (a base $\mathbf{32}_o$ of) the leg part 30 of the odd-numbered floor stand 10 that is the other floor stand 10 of the same set, and the sets of adjacent even-numbered and odd-numbered floor stands 10 can be moved forward in conjunction with each other while being aligned in the up and down direction. Movable stands 100 include a plurality of sets of even-numbered and odd-numbered floor stands 10, and the plurality of sets of floor stands 10 are expanded to a stepped form in a shortened use position. A switching drive unit 60 is disposed behind the leg parts 30 aligned in the left and right direction at a storage position of the movable stands 100. The switching drive unit 60 is engaged with the plurality of sets of mode switching units 50 in the storage position. When a movable part 62 of the switching drive unit 60 is driven, the switching levers 55 of the plurality of sets of the mode switching units 50 engaged with the movable part 62 are driven integrally in conjunction with the driving, to switch the plurality of sets of second stoppers 52 between the protruded state and the retracted state.

In the above description, the present disclosure has been explained in relation to one embodiment shown in FIGS. 1A to 9B, but the present disclosure is not limited to the illustrated embodiment only. Various modifications including modifications to be described below can be performed.

Advantageous Effects of Invention

According to the movable stands according to the aspect described above, switching between a mode of expanding to a normal use position and a mode of expanding to a shortened use position can be performed integrally with a simple operation.

BRIEF DESCRIPTION OF DRAWINGS

FIGS. 1A to 1C are side views of movable stands according to an embodiment of the present disclosure, in which FIG. 1A shows the stands in a storage position, FIG. 1B shows the stands in a shortened use position, and FIG. 1C shows the stands in a normal use position.

FIGS. 3A and 3B are perspective views of a second stopper of a mode switching unit of the movable stands in a retracted state, in which FIG. 3A is a front perspective view, and FIG. 3B is a rear perspective view.

FIGS. 4A and 4B are perspective views of the second stopper of the mode switching unit in a protruded state, in which FIG. 4A is a front perspective view, and FIG. 4B is a rear perspective view.

FIGS. 9A and 9B are views provided to explain an expansion operation of the movable stands, in which FIG. 9A shows an expanded state in a normal use position mode, and FIG. 9B shows an expanded state in a shortened use position mode.

DESCRIPTION OF EMBODIMENTS

Figure 1A:
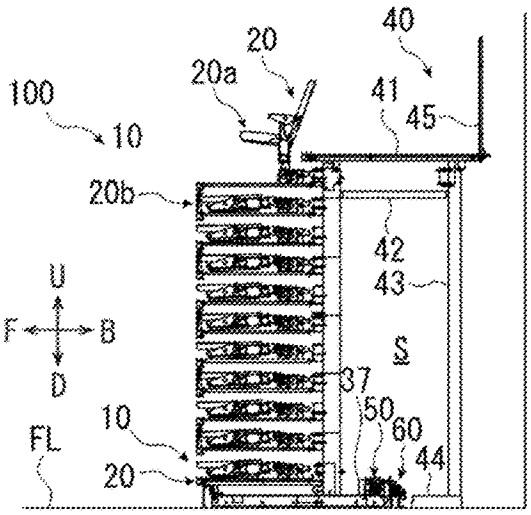

Hereinafter, movable stands according to an example of the present disclosure will be described with reference to the embodiment based on the drawings. Note that the embodiments are merely examples, and the present disclosure is not limited thereto. In the following description of the embodiments, similar components are denoted by the same reference numerals, and duplicate description will be omitted as appropriate.

The terms "front" and "back" as used herein with respect to movable stands 100 refer to a direction toward the lowermost step in the use position and a direction toward the uppermost step, and "left" and "right" refer to a left direction and a right direction when the movable stands 100 face the front. In each drawing, arrow F indicates the front, arrow B indicates the rear, arrow L indicates the left, arrow R indicates the right, arrow U indicates an upward direction, and arrow D indicates a downward direction. In each drawing, reference numerals indicating a plurality of identical members are omitted as appropriate as necessary.

The movable stands 100 according to the embodiment are installed on a floor surface FL of an indoor stadium, various halls, and the like, and are used as spectator seats.

Figure 1B:
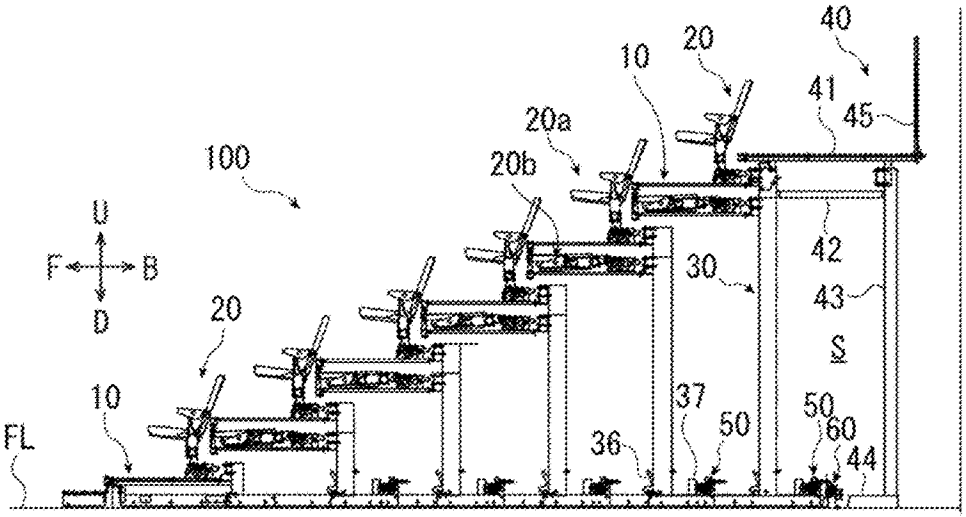
Figure 1C:
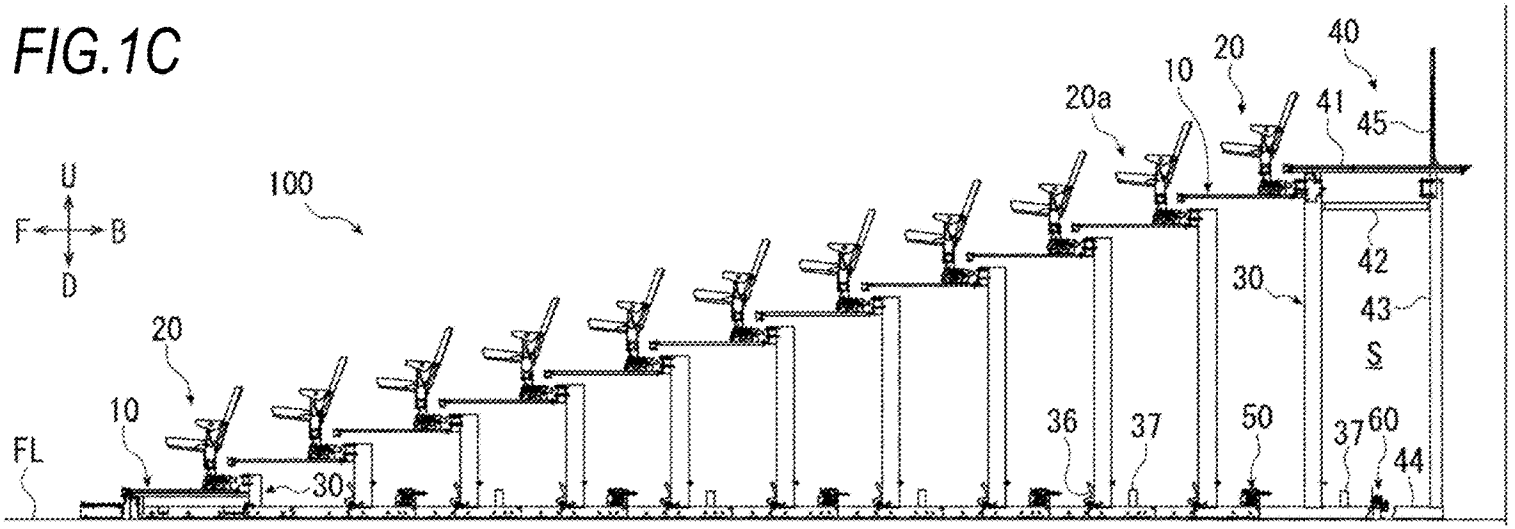

As shown in FIGS. 1A to 1C, the movable stands 100 roughly include a plurality of floor stands 10, connected chairs 20 disposed on each floor stand 10 and including a plurality of chairs connected side by side, leg parts 30 that support each floor stand 10 to be movable in a front and back direction in a horizontal state and that also engage with and move the floor stands 10 in conjunction with each other, and a fixed part 40 for fixing to a storage space S inside a wall surface and the like. Hereinafter, the plurality of floor stands 10 will be counted in ascending order, with the lowermost step being referred to as the first step floor stand 10.

The movable stands 100 may be selectively set to a storage position shown in FIG. 1A, a shortened use position shown in FIG. 1B, or a normal use position shown in FIG. 1C. In the storage position, the plurality of floor stands 10 forming the movable stands 100 are aligned in the up and down direction as a whole, and in the normal use position, the plurality of floor stands 10 are expanded to a stepped form one step at a time.

In the shortened use position, two sets of adjacent even-numbered and odd-numbered floor stands 10 excluding the first step floor stand, such as second and third steps, and fourth and fifth steps, are aligned in the up and down direction to form a set, and a plurality of sets of floor stands 10 are expanded out to a stepped form as a whole.

The connected chairs 20 are fixed on the floor stands 10 to be swingable up and down between a use state shown as 20*a* and a stored state shown as 20*b* in FIGS. 1A to 1C, through connecting pipes and leg materials on which a plurality of sit-stand chairs extend in the left and right direction.

Figure 2:
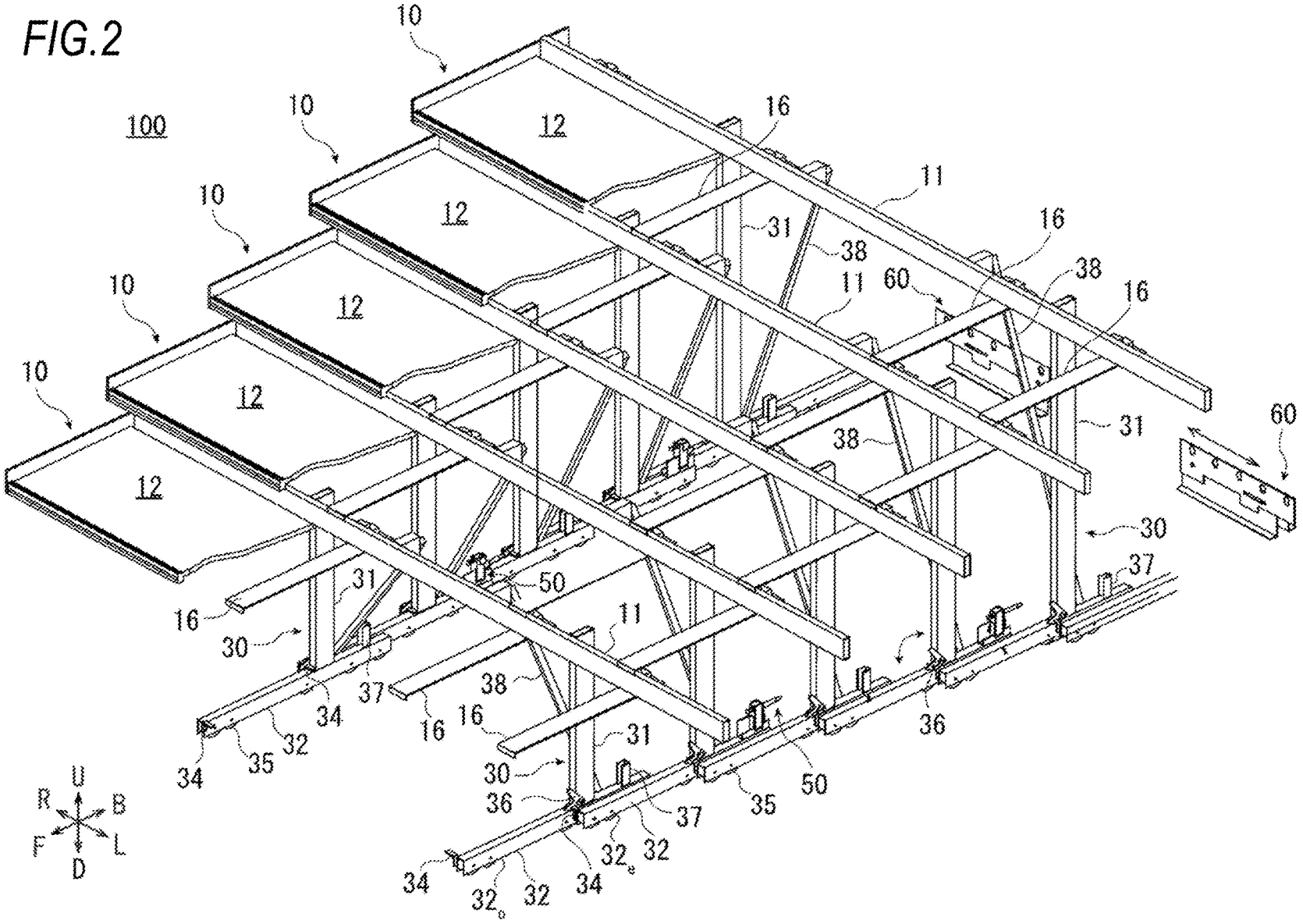
FIG. 2 is a partially cutaway perspective view of floor stands of the movable stands in a normal use position.

As shown in FIG. 2, each floor stand 10 includes a through member 11 extending horizontally in the left and right direction of the movable stands 100, a floor member 12 supported at a rear end portion by a lower surface of the through member 11 and extending horizontally in a lateral direction in front of the through member 11, and two pairs of longitudinal beams 16 disposed at intervals in the lateral direction of the floor stand 10 and extending horizontally from a lower end of the through member 11 in the front direction.

The leg part 30 includes a pair of left and right support columns 31 and a pair of left and right bases 32 coupled to lower end portions of the support columns 31. The support columns 31 are coupled to a back surface of the through member 11 and extend vertically downward. The base 32 has approximately the same width as the support column 31, extends in the front and back direction of the movable stands 100, and has the support column 31 fixed to an intermediate portion thereof.

The leg part 30 includes a brace 38 extending obliquely from near the base end portion of the support column 31 on each base 32 toward the through member 11 and the inside of the movable stands 100. The upper end of the brace 38 is coupled to the back surface of the through member 11. As such, the leg parts 30 support the floor stand 10 in a cantilevered manner.

The support column 31 is lengthened by a step difference for each floor stand 10 from the support column 31 coupled to the first step floor stand 10. A lateral distance between each pair of support columns 31 is narrower by approximately twice a width of the base 32 for each floor stand 10, starting from the support columns 31 coupled to the uppermost floor stand 10. As a result, in the storage position shown in FIG. 1A, the support columns 31 coupled to the vertically adjacent floor stands 10 are aligned side by side in the left and right direction.

As shown in FIG. 2, the pair of left and right bases 32 respectively coupled to the floor stand 10 are symmetrical in the left and right direction. In the following description, the L side base 32 will be described, and the description of the R side base 32 will be omitted.

Note that a base $\mathbf{32}_1$ (FIGS. 8A and 8B) coupled to the first step floor stand (hereinafter, the base will be referred to as the "first step base", and the same applies to the other bases 32), odd-numbered bases $\mathbf{32}_o$ excluding the first step base $\mathbf{32}_1$, and even-numbered bases 32*e* have different configurations. In the following description, the bases will be described as the base 32 unless it is necessary to distinguish the bases from each other, and if it is necessary to distinguish the bases from each other, the bases will be referred to as the bases $\mathbf{32}_1$, $\mathbf{32}_o$, and $\mathbf{32}_e$, respectively.

The base 32 is formed of a long grooved steel having a U-shaped cross section extending in the front and back direction and opening downward. A plurality of running rollers 35 are attached to the opening in series, so that the leg parts 30 can be moved in the front and back direction while supporting the floor stand 10 horizontally.

First stoppers 34 are attached to front ends of the bases $\mathbf{32}_o$ and $\mathbf{32}_e$. The first stoppers 34 are inverted L-angle shaped plate members, and fixed by suitable means such as screws such that upper surfaces thereof protrude toward the bases of the floor stand 10 one step below to the same extent as the width of the bases $\mathbf{32}_e$ and $\mathbf{32}_o$. The upper surfaces of the first stoppers 34 are slightly spaced apart from the upper surfaces of the bases to not interfere with the adjacent bases 32 when the bases $\mathbf{32}_o$ and $\mathbf{32}_e$ are aligned in the left and right direction in the storage position.

On the L side of the lower end of the support column 31 of the bases $\mathbf{32}_o$ and $\mathbf{32}_e$, an engagement member 36 having a downward claw and a lever-like release portion at a front end thereof is provided to be swingable in the up and down direction, as shown by the double-headed arrow in FIG. 2.

A stopper rest 37 is erected on an upper surface of a rear end portion of the odd-numbered base $\mathbf{32}_o$. The stopper rest 37 is a U-shaped grooved steel that is open forward in the plan view, and is attached by an appropriate means such as welding.

Meanwhile, on an upper surface of a rear end portion of the even-numbered base $\mathbf{32}_e$, a mode switching unit 50 is provided for switching between a normal use position mode in which the floor stands 10 coupled to the same base $\mathbf{32}_e$ are deviated and expanded to the stepped form with respect to the odd-numbered floor stands of the same set, and a shortened use position mode in which the floor stands are expanded in alignment with the odd-numbered floor stands of the same set. The mode switching unit 50 will be described in detail below.

Referring back to FIGS. 1A to 1C, the fixed part 40 includes a fixing member 44 extending along the base 32, a fixed support column 43 extending upward at a rear end of the fixing member 44, a fixed beam 42 fixed to the fixed support column 43 above the fixed support column 43 and extending in the front and back direction parallel to the fixing member 44, a chair-less top floor stand 41 supported on the uppermost floor stand 10 via the fixed support column 43, and a rear wall 45 erected at a rear end of the chair-less top floor stand 41.

The first stopper 34 is attached to the front end of the fixing member 44 in the same manner as when attached to the base 32.

As shown in FIG. 1A, in the storage position, a switching drive unit 60 is fixed at a position of facing the bases 32 aligned in the left and right direction. As shown in FIG. 2, a pair of switching drive units 60 are provided to correspond to a pair of left and right bases 32. The switching drive unit 60 will be described below. Because the switching drive units 60 are symmetrical in the left and right direction, in the same way as above, the L side will be described and the description of the R side switching drive unit 60 will be omitted.

The movable stands 100 are provided with a floor stand drive device (not shown) on the floor surface FL of the storage space S. The floor stand drive device is configured to unwind a belt-shaped chain having wheels on each connecting piece upon forward rotation of a drum and wind the chain onto the drum upon reverse rotation. A leading end of the belt-shaped chain is connected to the first step floor stand 10. By unwinding and winding the belt-shaped chain, it is possible to move the first step floor stand 10 in the front and back direction, and move all of the plurality of floor stands 10, which are directly or indirectly engaged with the first step floor stand 10 via the leg parts 30, in the front and back direction.

(Mode Switching Unit)

Figure 3A:
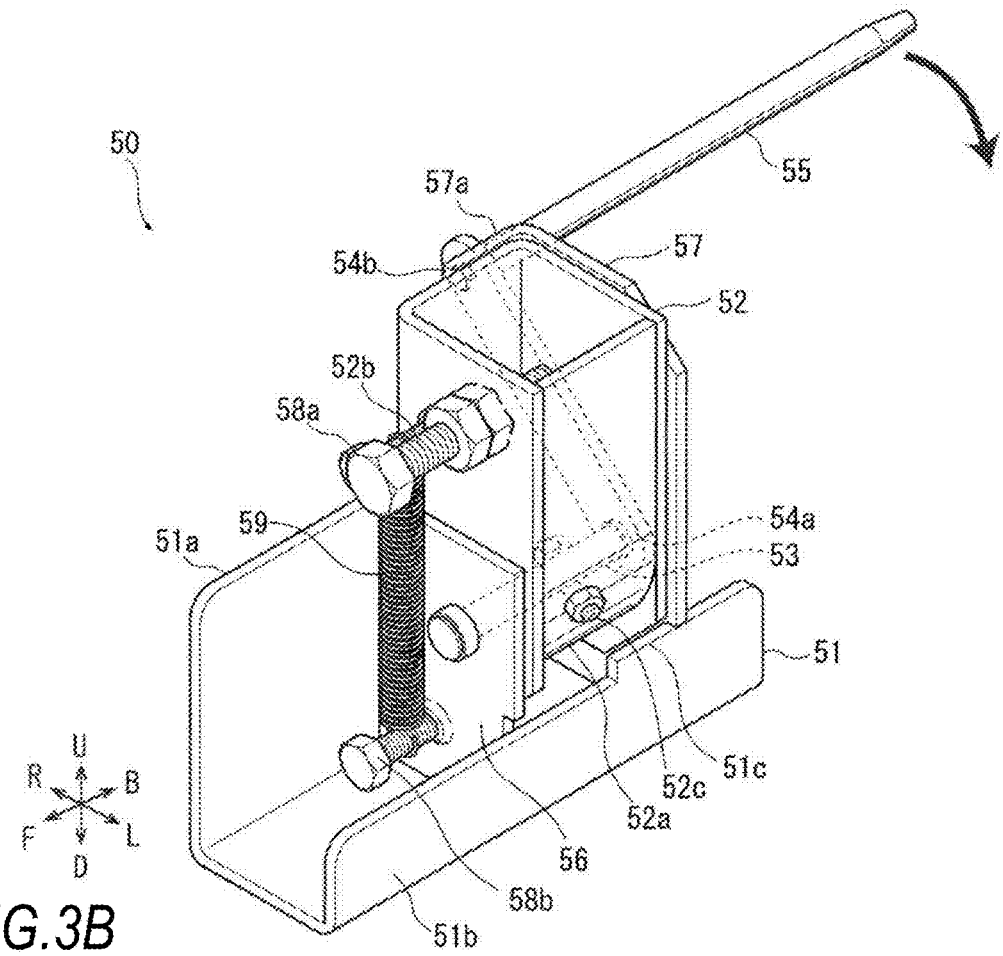
Figure 3B:
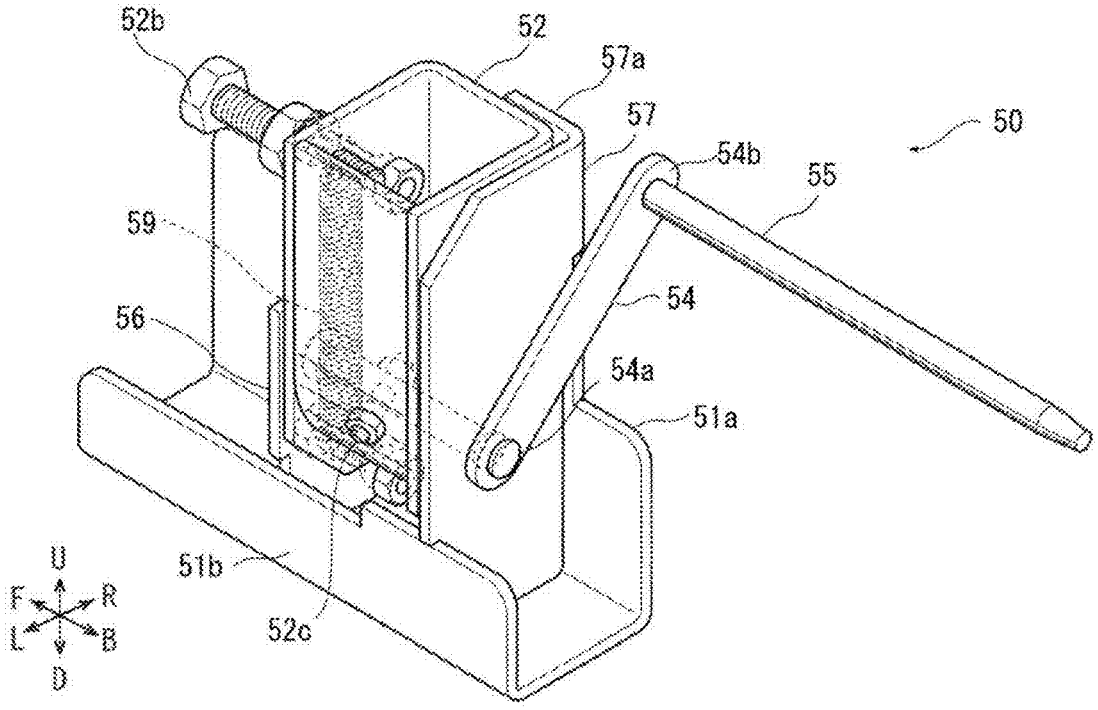
Figure 4A:
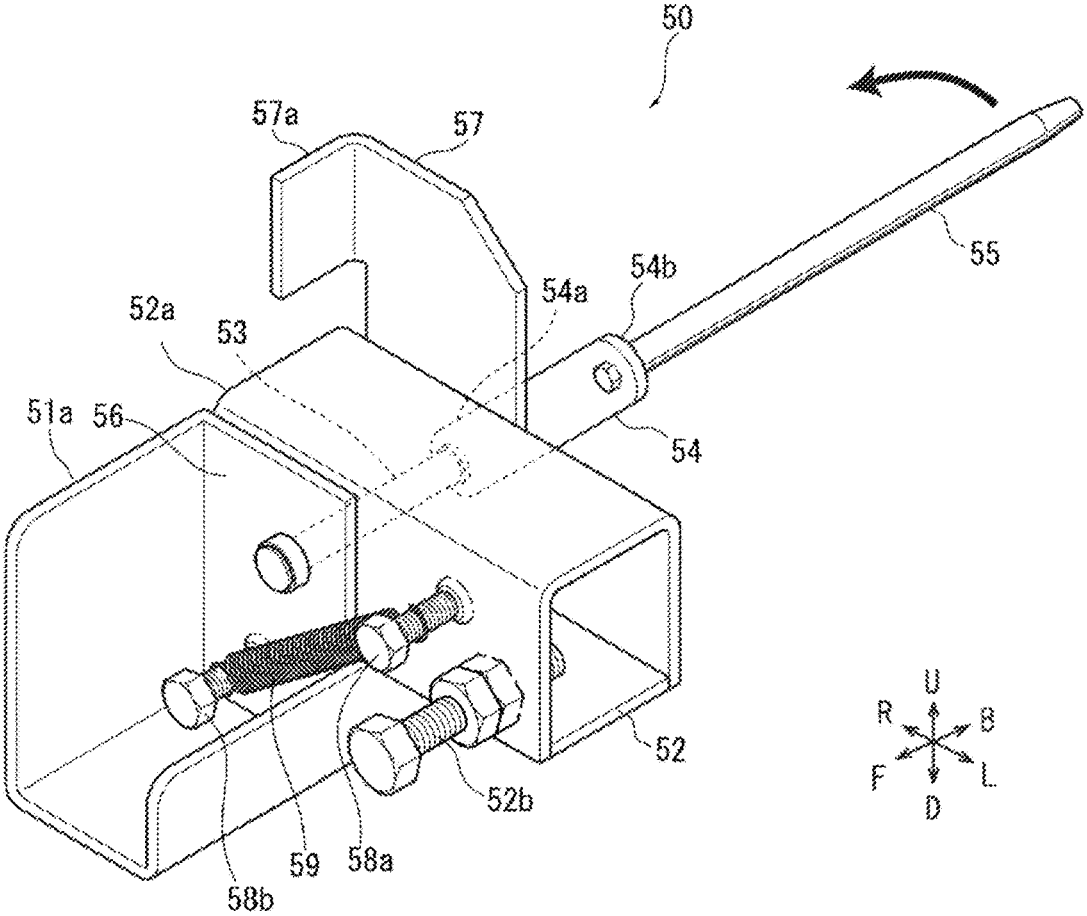
Figure 4B:
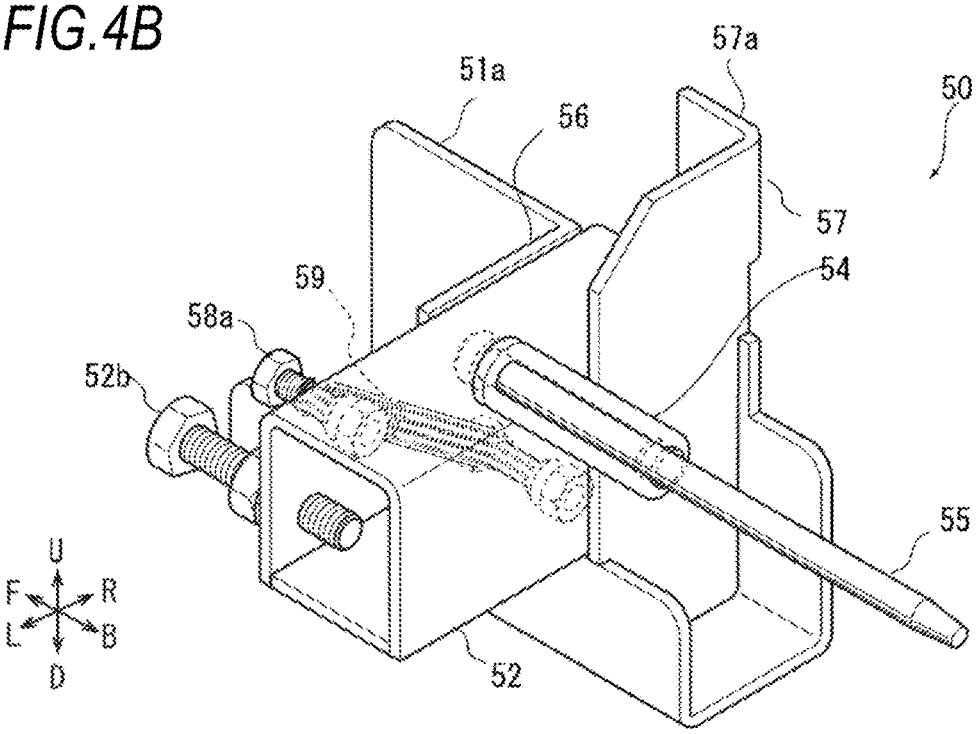
Figure 5A:
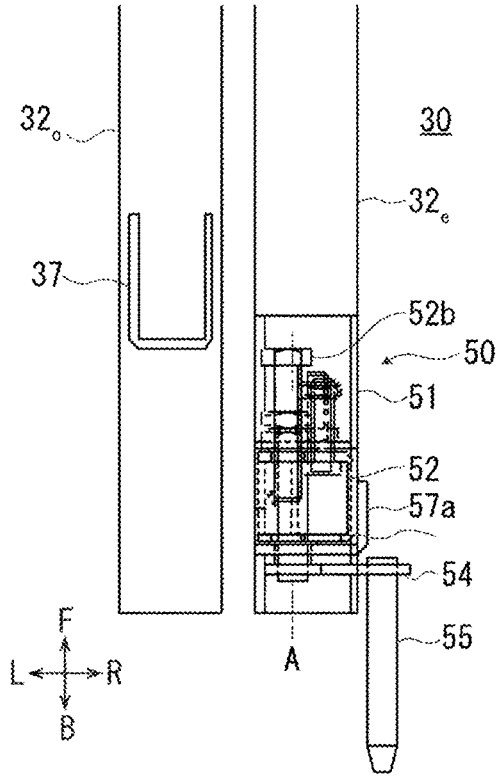
FIGS. 5A to 5D are views provided to explain an operation of the mode switching unit.
Figure 5B:
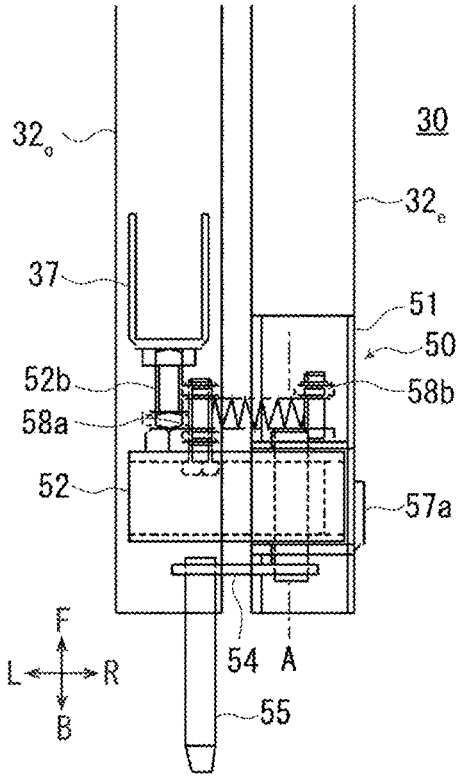
Figure 5C:
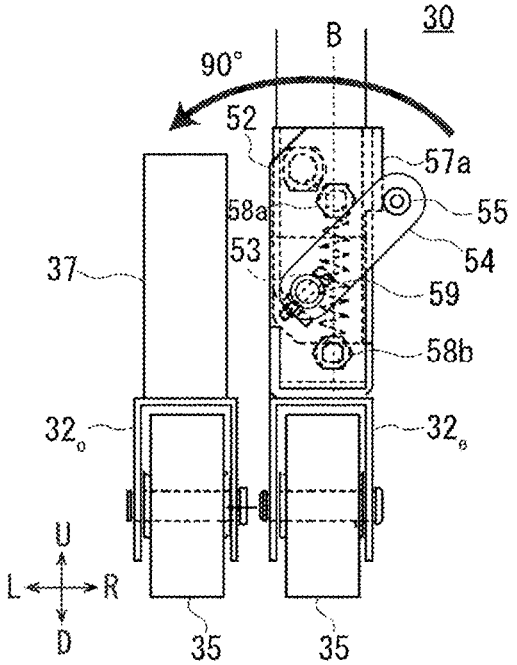
Figure 5D:
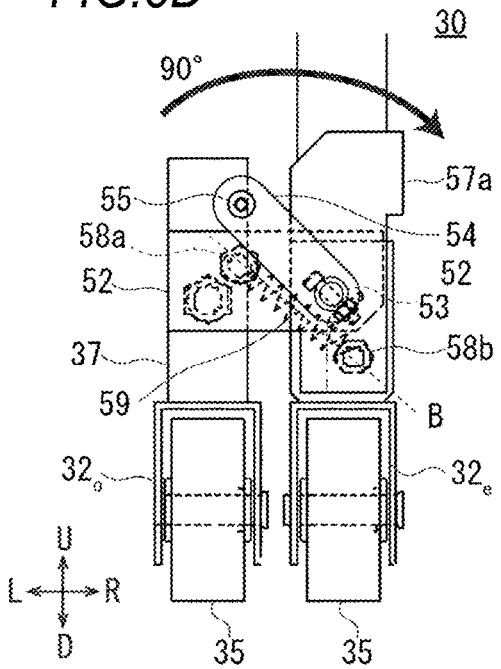

FIGS. 3A to 4B are perspective views of the mode switching unit 50, where FIGS. 3A and 3B show a state (hereinafter referred to as "retracted state") in which the second stopper is retracted, and FIGS. 4A and 4B show a state (hereinafter referred to as "protruded state") in which the second stopper 52 is protruded. FIGS. 5A and 5B are plan views of the rear end portions of a pair of bases $\mathbf{32}_o$ and $\mathbf{32}_e$ in the storage position of the movable stands 100, and FIGS. 5C and 5D are rear views of the same. FIGS. 5A and 5C show the second stopper 52 in the retracted state, and FIGS. 5B and 5D show the same in the protruded state.

The mode switching unit 50 roughly includes a pedestal part 51, the second stopper 52, a stopper rotating shaft 53 connected to the second stopper 52, a lever connecting plate 54, and the mode switching lever 55 (hereinafter referred to as the "switching lever").

The pedestal part 51 is a metal member extending in the front and back direction and opening upward, and having a substantially U-shaped cross section with a higher wall 51*a* on the R side and a lower wall 51*b* on the L side. The width of the pedestal part 51 in the left and right direction is approximately the same as or slightly narrower than that of the base 32. The second stopper 52 is a square tube having approximately the same width in the left and right direction as the pedestal part 51, and the base end portion 52*a* thereof is closed. A notch having a shape that matches the second stopper 52 is formed in an intermediate portion of the R-side wall 51*a*. Support walls 56 and 57 are erected from the bottom surface of the pedestal part 51 along the notches.

The stopper rotating shaft 53 extending in the front and back direction is rotatably supported around an axis (axis line) A shown in FIGS. 5A and 5B between the support walls 56 and 57. The base end portion 52*a* of the second stopper 52 is coupled to the stopper rotating shaft 53 with a bolt 52*c*. A bolt 52*b* is attached to a front surface of the second stopper 52. An upper portion of the support wall 57 is a bent portion 57*a* bent forward at a right angle.

A rear end portion of the stopper rotating shaft 53 is coupled to a first end portion 54*a* of the oblong lever connecting plate 54. The lever connecting plate 54 has a longitudinal axis line inclined at 45° in the R direction around the stopper rotating shaft with respect to the second stopper 52 in the retracted state. The rod-shaped switching lever 55 that extends rearward and has a tapered rear end portion is coupled to a second end 54*b* of the lever connecting plate 54.

In the retracted state of the second stopper 52, the second stopper 52 is attached with the longitudinal direction being the up and down direction, and the R side surface of the second stopper 52 is flush with the R side wall 51*a*. Here, if the switching lever 55 is moved 90 degrees in the L direction, the stopper rotating shaft 53 is rotated 90° via the lever connecting plate 54, and accordingly, the second stopper 52 is inclined in the L direction toward the adjacent odd-numbered step base 32. (one step above) around the stopper rotating shaft 53, and stops upon contacting an upper end 51*c* of the lower wall 51*b*. Here, the second stopper 52 is in the protruded state shown in FIGS. 4A and 4B.

In the protruded state, the second stopper 52 protrudes toward the L side, that is, toward the base $32_o$ one step above. Here, by moving the switching lever 55 from the L side to the R side, the second stopper 52 is swung around the stopper rotating shaft 53 in conjunction with the stopper rotating shaft 53, and moved into contact with the bent portion 57*a* of the support wall 57, thereby entering the retracted state in which the second stopper 52 is retracted.

Bolts are provided on the upper end of the front surface of the second stopper 52 and the support wall 56 as spring attachment portions 58*a* and 58*b*, respectively, and are shifted toward the R side from the stopper rotating shaft 53. A linear tension coil spring 59 is attached as an elastic member between the spring attachment parts 58*a* and 58*b*.

Due to the tension coil spring 59, in the rear views of FIGS. 5C and 5D, the second stopper 52 is biased in the retracting direction (R direction) when an axis line B of the tension coil spring 59 is further to the retracting direction (R direction) than the stopper rotating shaft 53, and biased in the protruding direction (L direction) when the tension coil spring 59 is further to the protruding direction (L direction).

As a result, by simply moving the switching lever 55 halfway, that is, by moving the switching lever 55 until the axis line B of the tension coil spring 59 exceeds the stopper rotating shaft 53 in the rear views when moving the second stopper 52 from the retracted state to the protruded state, and by moving the switching lever 55 until the axis line B of the tension coil spring 59 exceeds the stopper rotating shaft 53 in the rear views when moving the second stopper 52 from the protruded state to the retracted state, it is possible to prevent incomplete mode switching, because the elastic force of the tension coil spring can completely shift to the protruded state or retracted state.

Note that the mode switching unit 50 may be detachably attached to the base 32 with bolts and nuts, or may be fixed by welding or the like.

(Switching Drive Unit)

Figure 6A:
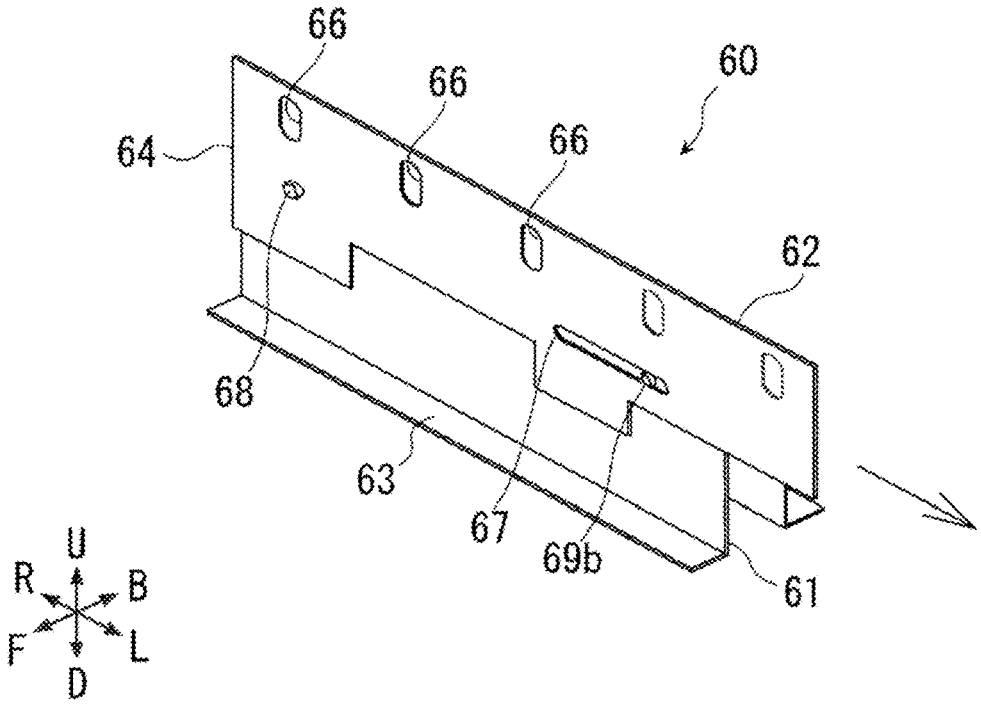
FIGS. 6A and 6B are perspective views of a switching drive unit of the movable stands.
Figure 6B:
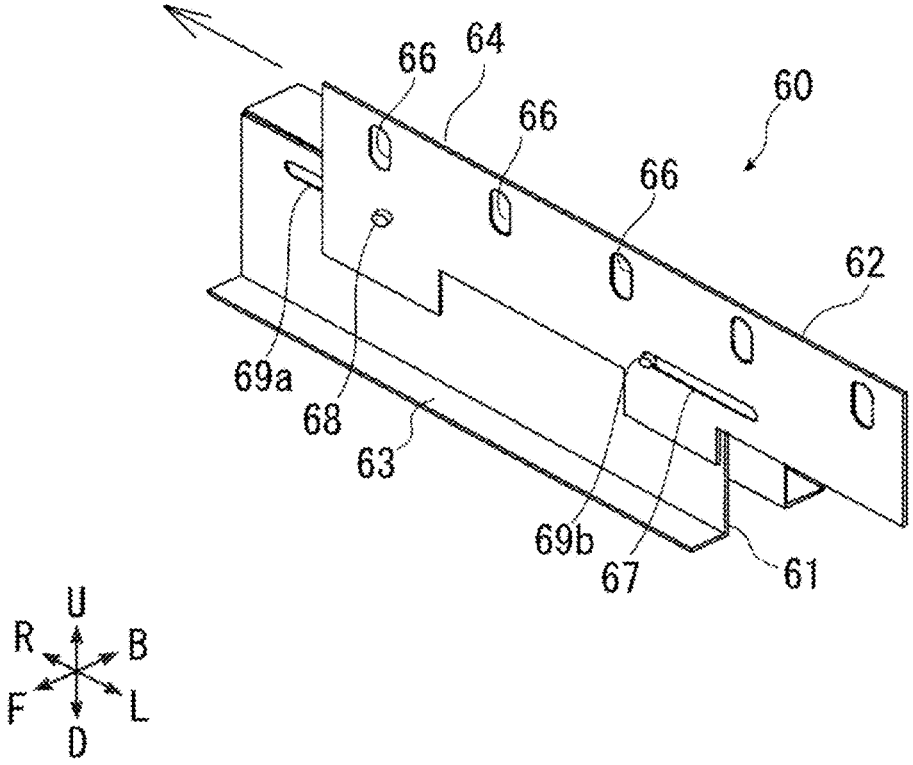
Figure 7A:
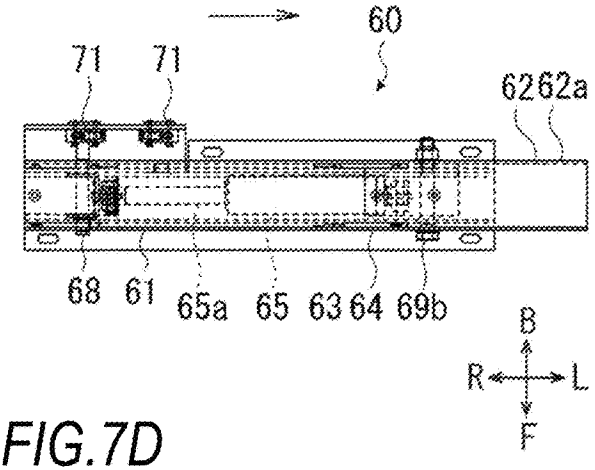
FIGS. 7A to 7E are views provided to explain a structure of the switching drive unit of the movable stands.
Figure 7B:
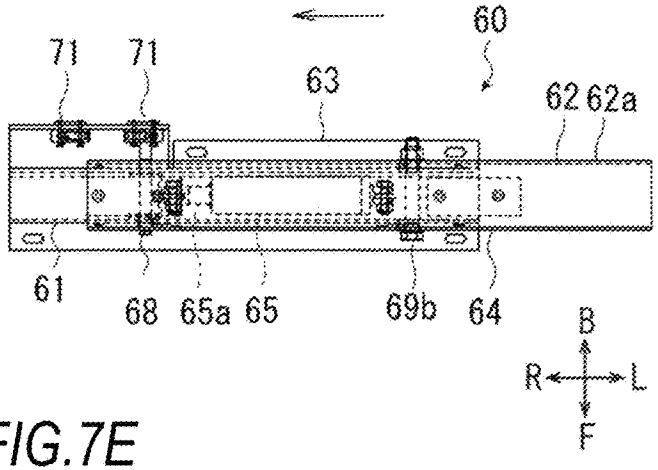
Figure 7C:
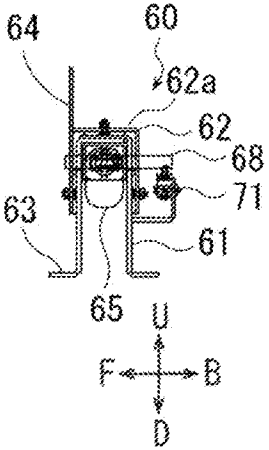
Figure 7D:
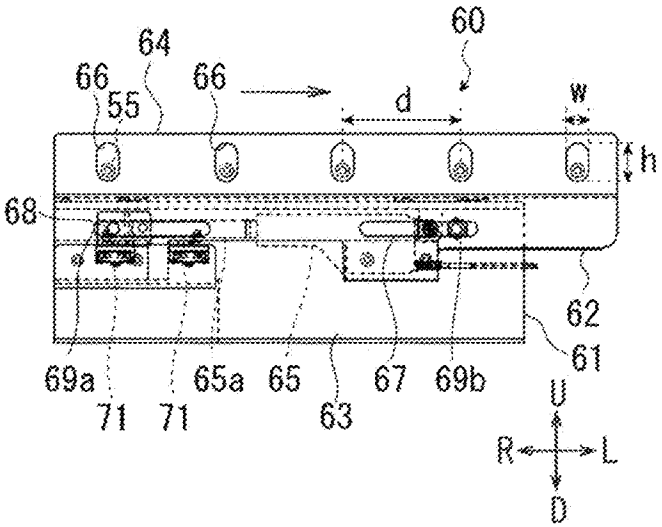
Figure 7E:
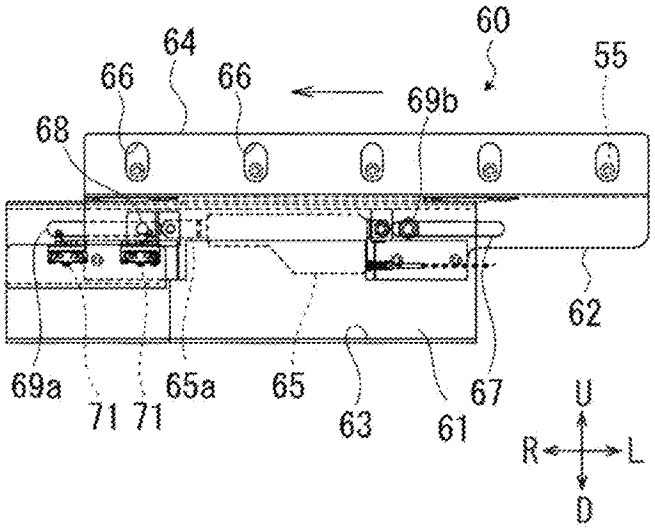

FIGS. 6A and 6B are perspective views of the switching drive unit 60. FIGS. 7A and 7B are plan views of the switching drive unit 60, FIG. 7C is a sectional view of the switching drive unit 60 in the front and back direction, and FIGS. 7D and 7E are front views of the switching drive unit 60. FIGS. 6A, 7A, and 7D show a mode in which the second stopper 52 is in the retracted state (a normal use position mode), and FIGS. 6B, 7B, and 7E show a mode in which the second stopper 52 is in a protruded state (a shortened use position mode).

The switching drive unit 60 includes a fixed part 61 and a movable part 62. The fixed part 61 is a rectangular parallelepiped metal member that extends in the left and right direction and has a substantially U-shaped cross section in the front and back direction with an opening on a lower end. In the cross section in the front and back direction, a blade-shaped ground part 63 is formed that extends in the front and back direction from the opening on the lower end, and the ground part 63 is fixed to the floor surface FL of the storage space S by a bolt or the like (not shown).

An electrically driven linear drive device 65 is provided within the fixed part 61. In the present example, the linear drive device 65 is a rod actuator. However, the present disclosure is not limited thereto, and any known linear drive mechanism such as a ball screw, linear guide, servo motor unit, air cylinder, and the like can be used. A rod 65*a* of the linear drive device 65 is coupled to the movable part 62 and the linear drive device 65 moves the movable part 62 in the left and right direction by expanding and contracting the rod 65*a*.

Guide windows 69*a* are formed on front and back surfaces of the fixed part 61, through which a connecting part 68 connecting the rod 65*a* and the movable part 62 is inserted and guided in the left and right direction. A guide pin 69*b* is also provided, which penetrates and protrudes in the front and back direction and is inserted into a guide window 67 of the movable part 62, which will be described below. A pair of limit switches 71 are provided on the R-side back surface of the fixed part 61 at positions corresponding to the R-side end and the L-side end of the guide window 69*a*, defining stop positions of the connecting part 68 in the left and right direction.

The movable part 62 includes a flat plate part 64 that is substantially rectangular and that extends in the up and down and left and right directions, and a guide part 62*a* having an inverted L-shaped cross section that is provided on the back surface of the flat plate part 64 and is aligned with the upper portion of the fixed part 61. The guide part 62*a* is able to run on the upper surface of the fixed part 61 like a straddle type monorail.

There are oblong lever insertion holes 66 provided at predetermined intervals and aligned in the left and right direction in an upper portion of the flat plate part 64. The lever insertion holes 66 are formed according to the number of the mode switching units 50 provided in the movable stands 100. A distance d (FIG. 7D) between the lever insertion holes 66 is approximately twice the width of the base 32.

The switching drive unit 60 is fixed to the floor surface FL of the storage space S, facing the base 32 aligned in the left and right direction in the storage position such that the position of the switching lever 55 in which the second stopper 52 of the mode switching unit 50 is in the retracted state corresponds to the position of the lever insertion hole 66 in the normal use position mode shown in FIGS. 6A, 7A, and 7D.

A horizontal dimension w (FIG. 7D) of the lever insertion hole 66 is set to be slightly larger than the dimension of the switching lever 55, considering the positional accuracy during the expansion and storage movements of the base 32. A vertical dimension h (FIG. 7D) is set considering the vertical movement that occurs when the switching lever 55 moves in the left and right direction during mode switching.

The rod-shaped connecting part 68 connected to the linear drive device 65 is attached to a lower portion of the L side of the movable part 62 to protrude rearward from the flat plate part 64 through the back surface of the guide part 62*a*. The oblong guide window 67 extending in the left and right direction is formed in the lower part of the R side of the flat plate part 64, through which the guide pin 69*b* protruding from the fixed part 61 is inserted to guide the horizontal movement of the movable part 62.

By driving the linear drive device 65, the movable part 62 is moved in the left and right direction in conjunction with the connecting part 68 connected to the linear drive device 65 to switch the limit switch 71 at both ends. As such, it is possible to move between the normal use position mode shown in FIGS. 6A, 7A, and 7D, and the shortened use position mode shown in FIGS. 6B, 7B, and 7E.

Figure 8B:
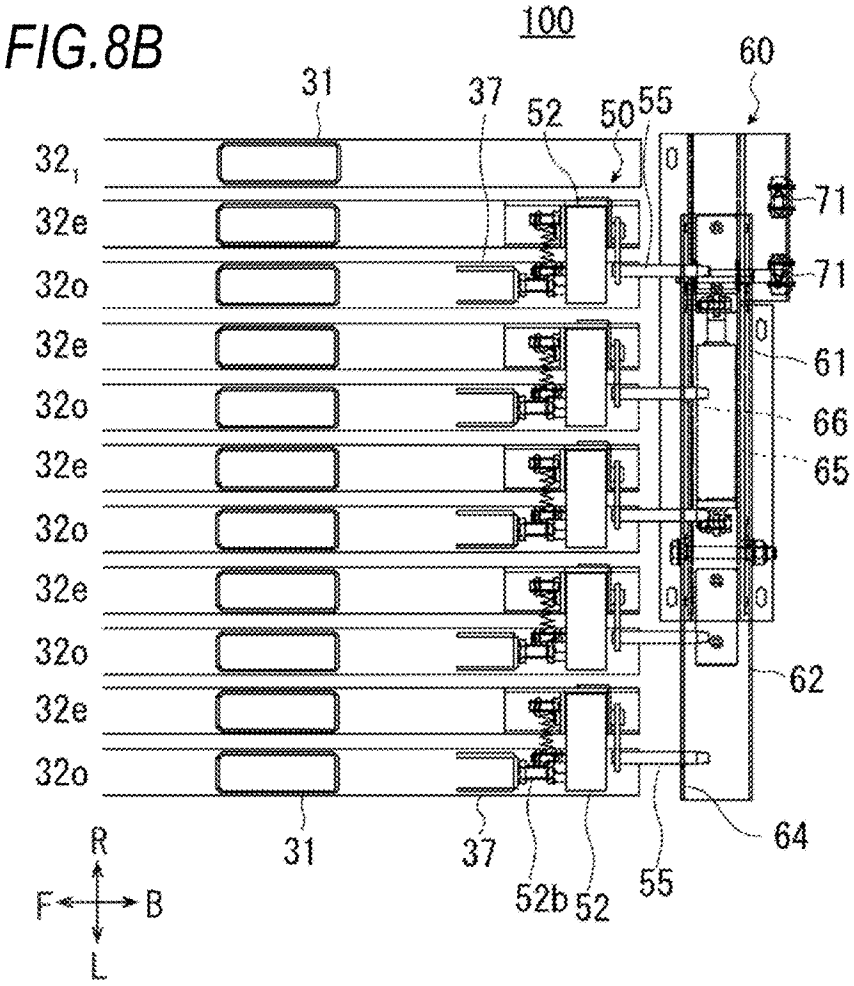
FIGS. 8A and 8B are views provided to explain the operation of the switching drive unit.
Figure 8A:
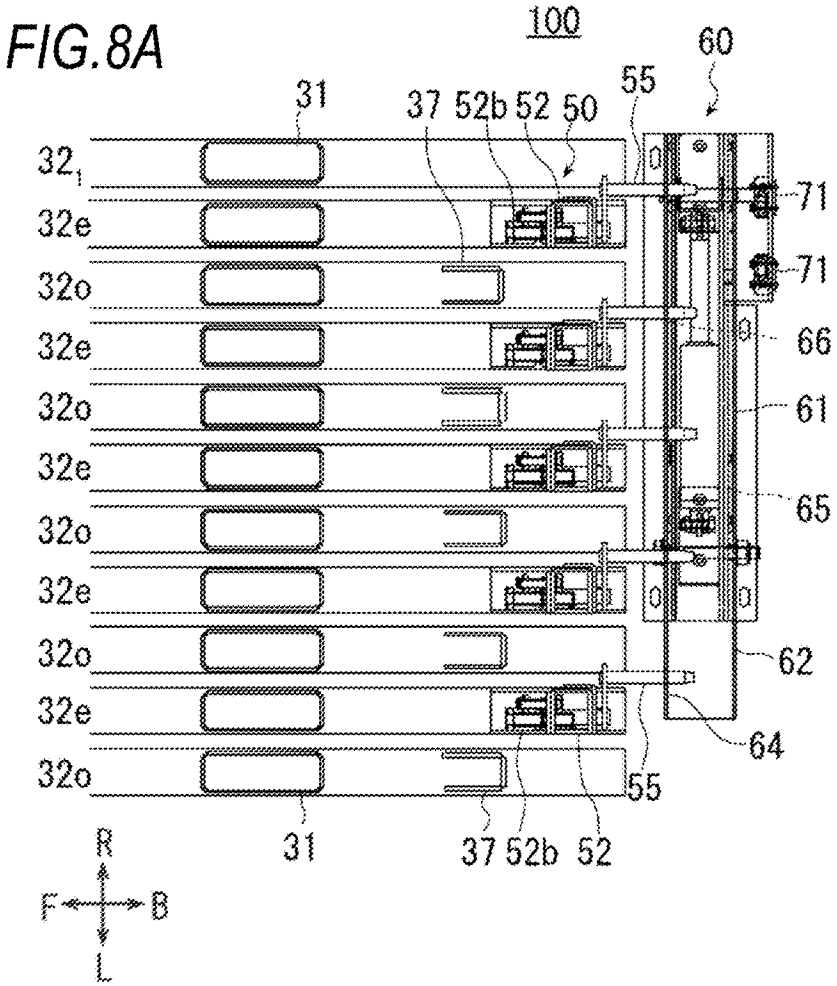

Then, as shown in FIGS. 8A and 8B, with the movable stands 100 in the storage position and the rear end of the switching lever 55 corresponding to the lever insertion hole 66 being inserted into the lever insertion hole 66, by driving the linear drive device 65, in conjunction with the driving of the movable part 62 in the L direction, it is possible to integrally switch all sets of the mode switching units 50 from the normal use position mode of FIG. 8A to the shortened use position mode of FIG. 8B. By driving the movable part 62 in the R direction, it is possible to switch from the shortened use position mode to the normal use position mode.

(Expansion Operation of Movable Stands)

The expansion operation of the movable stands 100 will be described below with reference to a schematic plan view of some (first to fourth steps) of the movable stands 100 in FIGS. 9A and 9B.

(Normal Position Mode)

When the normal use position mode shown in FIG. 8A is set, all the second stoppers 52 are in the retracted state.

Figure 9A:
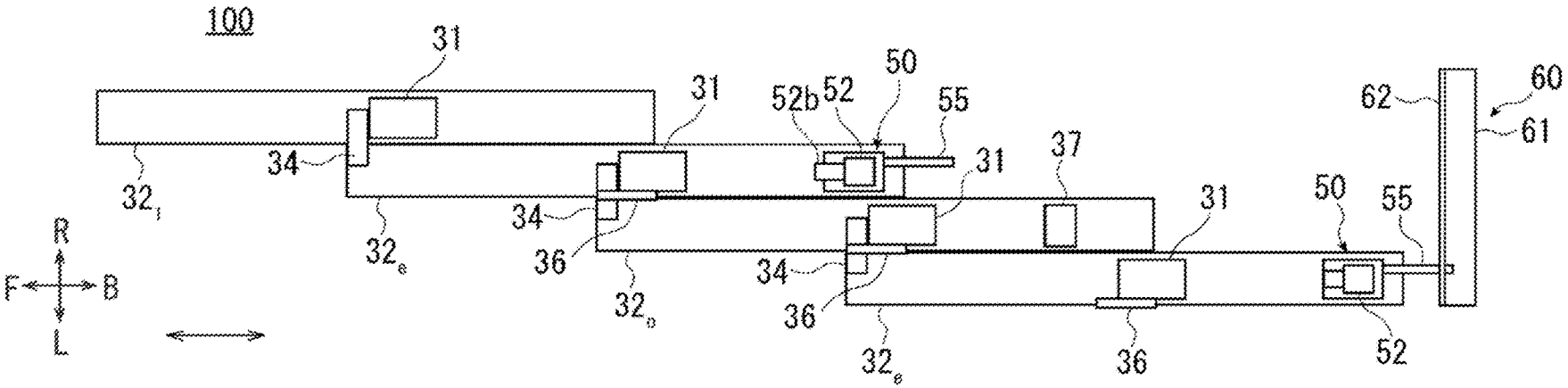
Figure 9B:
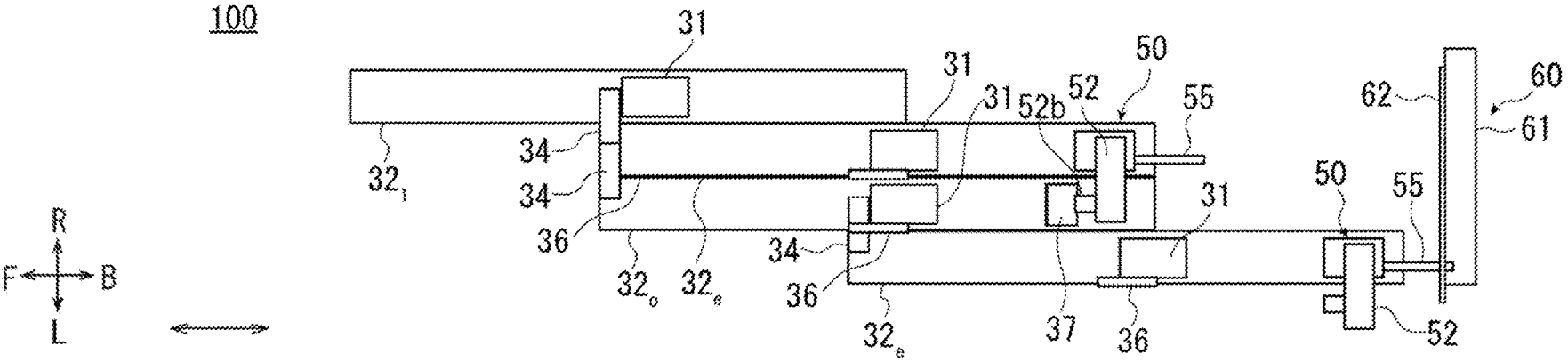

As shown in FIG. 9A, when the movable stands 100 are moved forward from the storage position to the normal use position, first, the first step base $\mathbf{32}_1$ is moved forward. As the base $\mathbf{32}_1$ is moved forward, the first stopper 34 of the second step base $\mathbf{32}_e$ is brought into contact with the support column 31 of the base $\mathbf{32}_1$. When the first step base $\mathbf{32}_1$ continues to be moved forward, the support column 31 of the first step base $\mathbf{32}_1$ is engaged with the second step base $\mathbf{32}_e$ and moved further forward while being deviated by a predetermined distance.

When the first stopper 34 of the third step base $\mathbf{32}_o$ is brought into contact with the front end of the engagement member 36 of the second step base $\mathbf{32}_e$ by the forward movement of the second step base $\mathbf{32}_e$, the engagement member 36 is swung upward around the rotating shaft, during which the first stopper 34 is relatively retreated and brought into contact with the front surface of the support column 31 of the second step base $\mathbf{32}_e$. Here, the claw of the engagement member 36 is engaged with the front end of the first stopper 34 of the third step base $\mathbf{32}_o$.

Likewise, as the first stopper 34 is moved forward while being sequentially engaged with the support columns 31 of the base 32 one step above, it is shifted from the step that is one step below by a predetermined distance, thereby expanding to the normal use position shown in FIG. 1C. Then, the connected chairs 20 are erected.

Meanwhile, when retreating from the normal use position to the storage position, first, although not shown, the connected chairs 20 on each floor stand 10 are collapsed forward to be in the storage state. When the first step base $\mathbf{32}_1$ is retreated by the floor stand drive device, the first step base $\mathbf{32}_1$ is aligned with the second step base $\mathbf{32}_e$ in the left and right direction.

The through member 11 extending horizontally in the left and right direction of the first step floor stand 10 pushes the engagement member 36 at the lower end of the support column 31 of the second step floor stand 10 rearward to cause the engagement member 36 to be swung upward, thereby releasing the engagement between the first stopper 34 at the front end of the third step base $\mathbf{32}_o$ and the engagement member 36. The through member 11 further pushes the support column 31, and as a result, the first step floor stand 10 and the second step floor stand 10 are retreated together.

Next, when the first step base $\mathbf{32}_1$ and the second step base $\mathbf{32}_e$ are moved back and aligned with the third step base $\mathbf{32}_o$ in the left and right direction, the through member 11 of the first step floor stand 10 pushes the release portion of the engagement member 36 of the third step floor stand 10. Then, the engagement member 36 is swung to release the engagement with the first stopper 34 of the fourth step base $\mathbf{32}_e$ and push the support column 31. The process is repeated sequentially so that the movable stands are placed in the storage position.

(Shortened Use Position Mode)

Meanwhile, when the shortened use position mode shown in FIG. 8B is set, all the second stoppers 52 are in the protruded state.

When the movable stands 100 are moved forward from the storage position to the shortened use position, first, the first step base $\mathbf{32}_1$ is moved forward. As the base $\mathbf{32}_1$ is moved forward, the first stopper 34 of the second step base $\mathbf{32}_e$ is brought into contact with the support column 31 of the first step base $\mathbf{32}_1$, as shown in FIG. 9B.

When the first step base $\mathbf{32}_1$ continues to be moved forward, the support column 31 of the first step base $\mathbf{32}_1$ pushes the first stopper 34 of the second step base $\mathbf{32}_e$ and is moved further forward while being deviated by a predetermined distance.

Here, the head of the bolt 52*b* of the second stopper 52 of the second step base $\mathbf{32}_e$ is brought into contact with the back surface of the stopper rest 37 of the third step base $\mathbf{32}_o$, the stopper rest 37 of the third step base $\mathbf{32}_o$ is engaged with the second stopper 52 of the second step base $\mathbf{32}_e$, and the second step base $\mathbf{32}_e$ and the third step base $\mathbf{32}_o$ are integrally moved forward while being aligned in the left and right direction.

When the first step base $\mathbf{32}_1$ is moved forward, the forward movement thereof causes the first stopper 34 of the fourth step base $\mathbf{32}_e$ to swing the engagement member 36 of the third step base $\mathbf{32}_o$ upward to be brought into contact with the support column 31 of the third step base $\mathbf{32}_o$ and engaged with the engagement member 36.

Then, by moving forward while sequentially repeating interference between the stopper rest 37 and the second stopper 52 and engagement between the first stopper 34 on the upper step and the support column 31 of the base 32 that is one step above, each of the floor stands 10 form a set of two steps and are deviated by a predetermined distance, and each of the floor stands 10 form a set of two steps and aligned in the up and down direction, according to which the respective steps are arranged in the shortened use position in which the sets are expanded to the stepped form as a whole.

The movable stands according to the present embodiment are configured to include the switching drive unit that can integrally switch between the normal use position mode and the shortened use position mode, that is, switch between the protruded state and the retracted state of the second stoppers 52 of all floor stand sets, thereby easily performing mode switching work which is complicated in the related art where it is required to protrude and retract the second stoppers one by one.

In the movable stands according to the present embodiment, the mode switching unit 50 for switching the second stopper 52 between the protruded state and the retracted state is configured to include the second stopper 52 coupled to the stopper rotating shaft 53 to be rotatable around an axis extending in the front and back direction, and the switching lever coupled to the stopper rotating shaft 53 and protrudes rearward from the leg part, thereby easily performing the mode switching work behind the storage position of the movable stands 100.

The movable stands 100 according to the present embodiment are advantageously used, because is the movable stands 100 are configured such that the second stopper 52 can be switched between the protruded state and the retracted state simply by moving the switching lever of the mode switching unit in the left and right direction from behind the leg part, and thus requires, for the driving of the mode switching, a very simple device that includes the movable part 62 that linearly moves in the left and right direction and the fixed part 61 that supports the movable part 62.

Therefore, switching the switching drive unit 60 can be performed using a simple linear drive device such as a rod actuator, which is particularly preferable.

<First Modification>

Figure 10B:
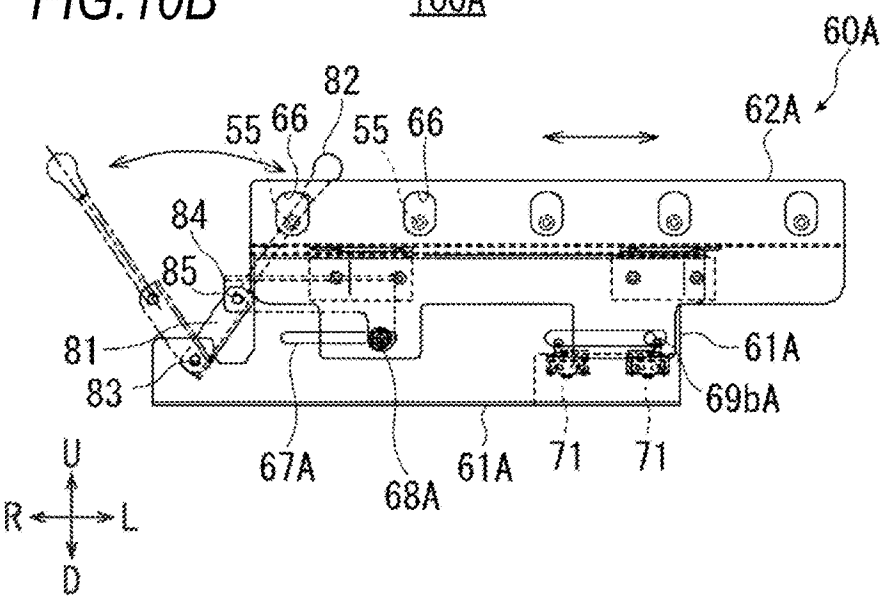
FIGS. 10A and 10B are views showing a switching drive unit of one modification of the movable stands according to the present embodiment.
Figure 10A:
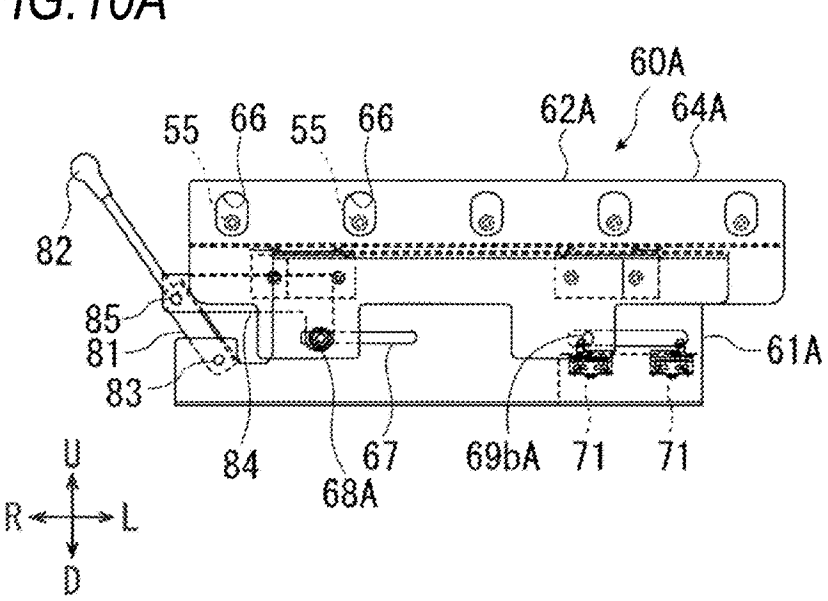

FIGS. 10A and 10B are front views of a switching drive unit 60A of movable stands 100A according to a first modification, in which FIG. 10A shows a normal use position mode, and FIG. 10B shows a shortened use position mode.

A fixed part 61A and a movable part 62A have roughly the same configuration as the fixed part 61 and the movable part 62. However, the switching drive unit 60A does not include the linear drive device 65. The switching drive unit 60A includes a swing lever 82 coupled to a first connecting plate 81 swingably attached to the R side of the fixed part 61A around a fulcrum 83 provided at one end. The first connecting plate 81 is coupled to a second connecting plate 84 at the other end 85. The second connecting plate 84 is rotatably attached to the movable part 62A around the connecting part 68A. As a result, by swinging the swing lever 82 in the left and right direction, the movable part 62A is moved in the left and right direction. In the movable stands 100A, the limit switches 71 are provided on the L side and can be switched by a guide pin 69*b*A.

As such, the switching drive unit 60A does not necessarily need to be driven electrically, and may be driven manually.

The switching drive unit 60A according to the present embodiment is configured to be able to switch the second stopper 52 of the mode switching unit 50 between the protruded state and the retracted state by a simple movement of moving straight in the left and right direction, thereby performing mode switching even manually without requiring a particularly complicated mechanism.

<Second Modification>

Figure 11A:
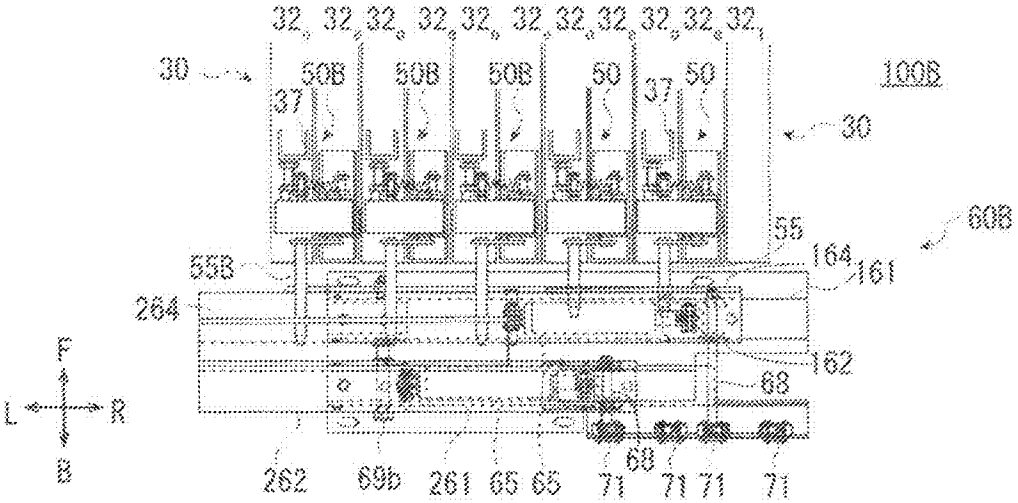
FIGS. 11A to 11D are views showing a switching drive unit of another modification of the movable stands according to the present embodiment.
Figure 11B:
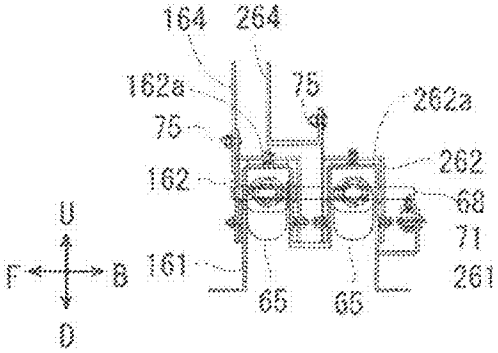
Figure 11C:
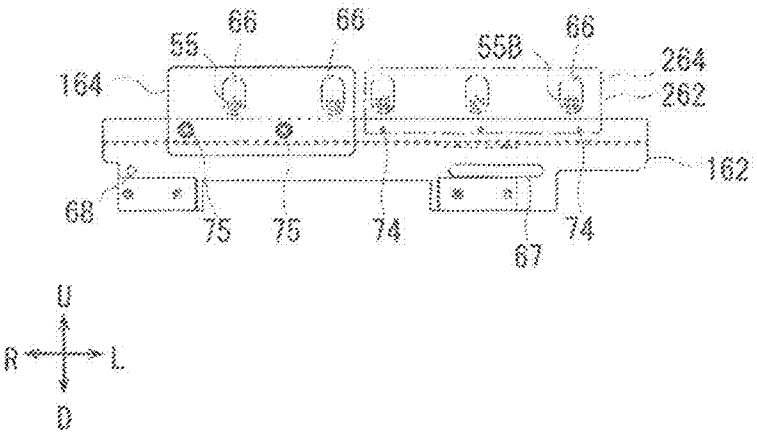
Figure 11D:
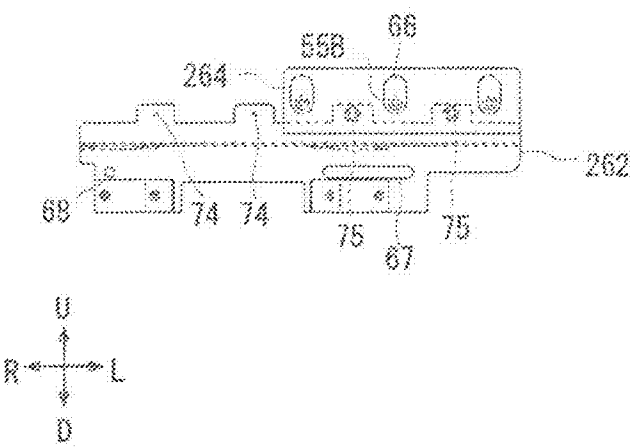

FIGS. 11A to 11D are views showing a switching drive unit 60B of movable stands 100B according to a second modification. FIG. 11A is a plan view showing the overall configuration of the switching drive unit 60B set to the shortened use position mode in the storage position of the movable stands 100B, FIG. 11B is a cross-sectional view thereof in the front and back direction, FIG. 11C is a front view of a first movable part 162, and FIG. 11D is a front view of a second movable part 262.

The switching drive unit 60B schematically has a structure in which two switching drive units 60 are deviated and disposed in the front and back direction. That is, a first fixed part 161 and the first movable part 162 are disposed at the front, and a second fixed part 261 and the second movable part 262 are disposed in the back. The first fixed part 161 and the second fixed part 261 are integrally formed continuously at an intermediate portion in the front and back direction.

A flat plate part (first flat plate part) 164 of the first movable part 162 is disposed to face the leg parts (second to fifth step leg parts) 30 of some of the plurality of sets (of the floor stands 10) that include the mode switching unit 50, and a flat plate part (second flat plate part) 264 of the second movable part 262 is disposed to face the leg parts (sixth to eleventh step leg parts) 30 of the remaining set of the plurality of sets that include a mode switching unit 50B. The first flat plate part 164 is attached to the front surface of a guide part 162*a* of the first movable part 162. The second flat plate part 264 is bent rearward at the lower end and is attached to protrude forward from the front surface of the guide part 262*a* of the second movable part 262. The second movable part 262 is configured to not interfere with the first movable part 162 while being moved in the left and right direction.

A switching lever 55B of the mode switching unit 50B is extended to a length such that the switching lever 55B passes through the lever insertion hole 66 of the second movable part 262 in the storage position. The first and second flat plate parts 164 and 264 have dimensions so that the first flat plate part 164 and the second flat plate part 264 do not interfere with each other even when the first movable part 162 is set to the shortened use position mode and the second movable part 262 is set to the normal use position mode as shown by the dashed line in FIG. 11C.

In the example of FIGS. 11A to 11D, the first movable part 162 is able to switch the expansion mode of the lower two sets among the five sets of floor stands 10, that is, the second to fifth steps, and the second movable part 262 is able to switch the expansion mode of the upper three sets, that is, the sixth to eleventh steps. The first movable part 162 and the second movable part 262 can be independently moved in the left and right direction by the individually provided linear drive device 65. It becomes possible to set the expansion patterns as shown in Table 1 below.

TABLE 1

Figure 12A:
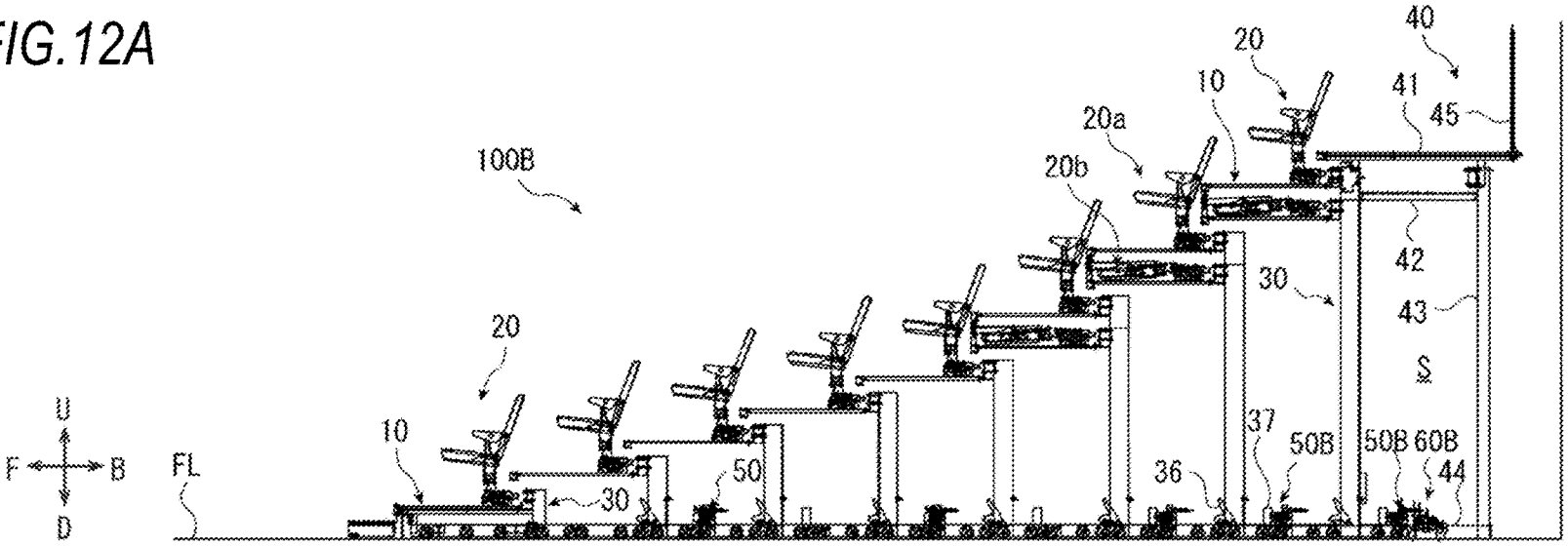
FIGS. 12A and 12B are side views provided to explain a configuration of the movable stands in the expanded state according to the modification.
Figure 12B:
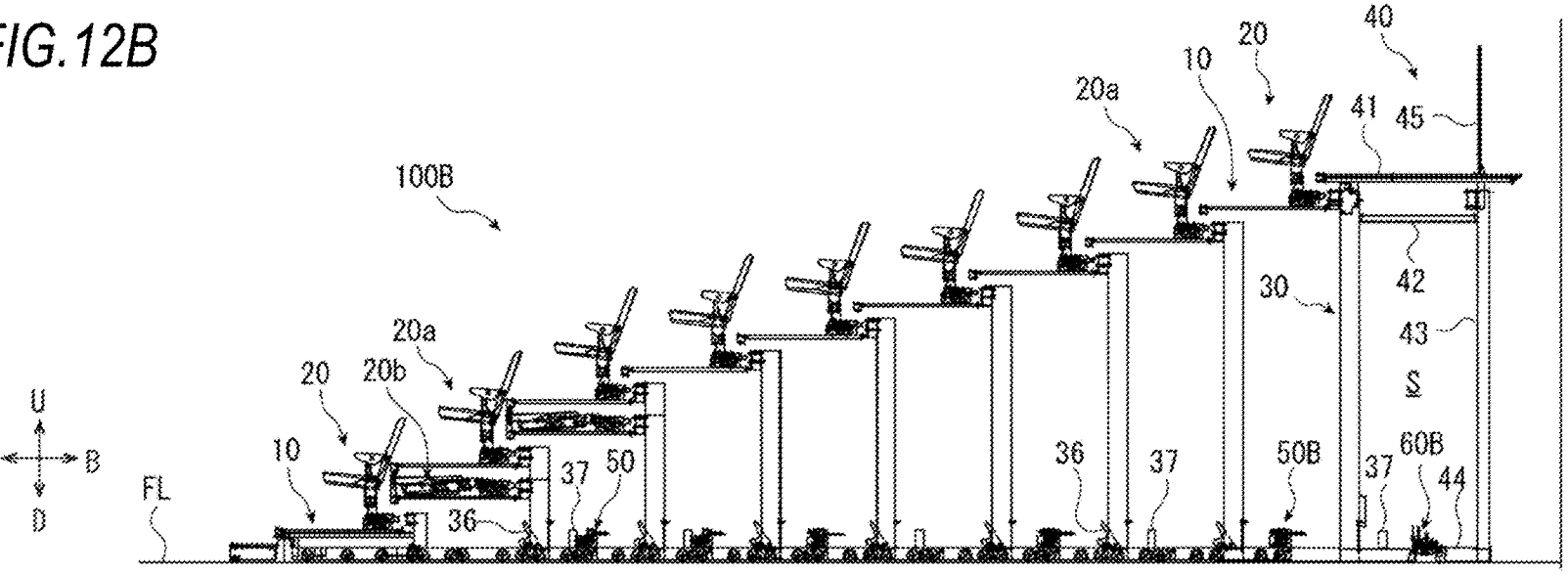

| Expansion patterns determined by combination of first and second movable parts | | | |
|---|---|---|---|
| | | First movable part | |
| | | Normal use position mode | Shortened use position mode |
| Second movable part | Normal use position mode | Same as FIG. 1C | FIG. 12B |
| | Shortened use position mode | FIG. 12A | Same as FIG. 1B |

Accordingly, it is possible to respond to an expansion pattern that matches the needs of consumers.

Note that the first and second flat plate parts 164 and 264 are detachably attached to the first and second movable parts 162 and 262 with through holes 74 and screws 75 (and nuts, not shown) provided in the first and second movable parts 162 and 262, respectively.

The first and second flat plate parts 164 and 264 are not necessarily detachable, and may be fixed by welding or the like, or may be integrally formed. However, it is advantageous if the flat plate parts are detachable because, as shown in FIGS. 13A to 13D, a set of first and second flat plate parts with different combinations of the number of lever insertion holes 66 may be prepared and be replaced with the first and second flat plate parts 164 and 264, thereby enabling expansions in even more various patterns.

Figure 13A:
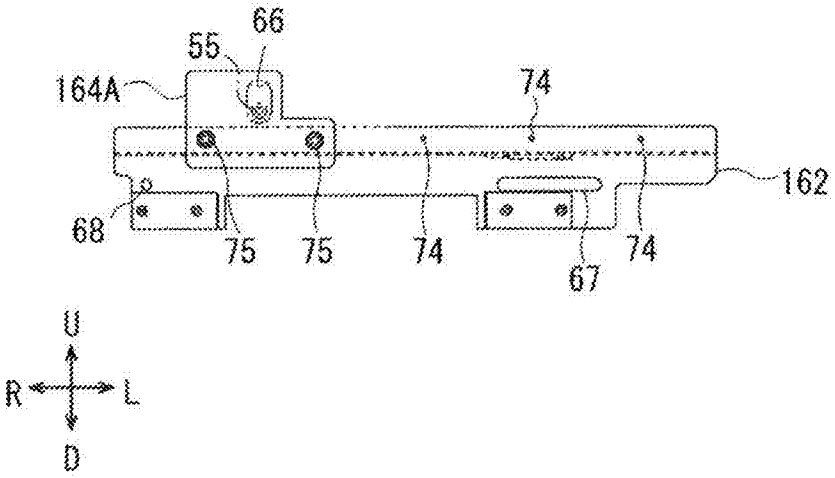
FIGS. 13A to 13D are views showing another configuration example of the movable part of the switching drive unit according to the modification.
Figure 13B:
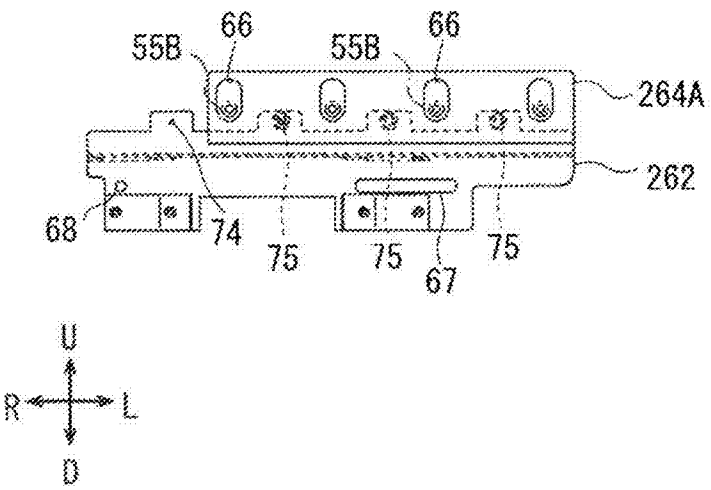
Figure 13C:
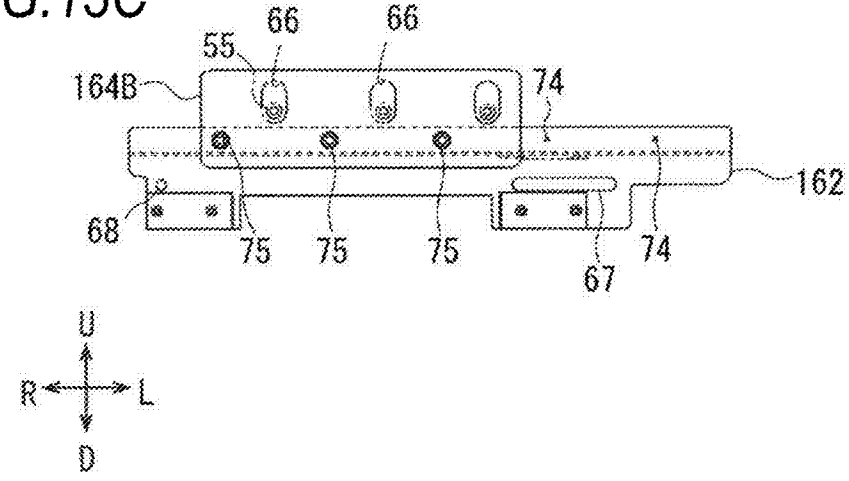
Figure 13D:
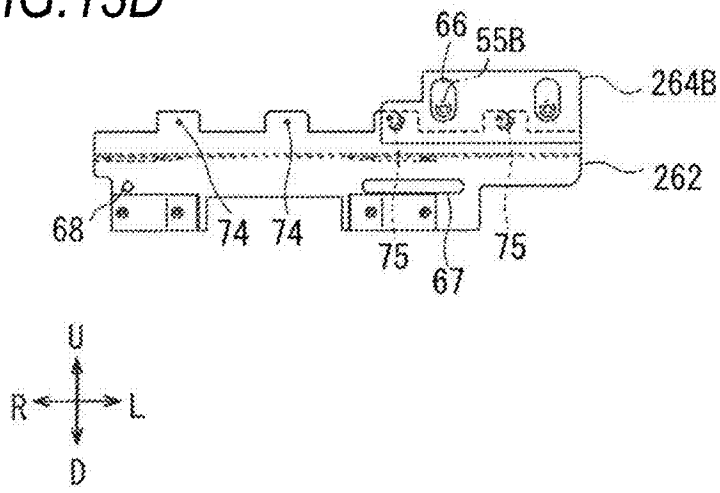

Specifically, as shown in FIGS. 13A and 13B, when the movable stands are configured such that the number of lever insertion holes 66 is one in a first flat plate part 164A and four in a second flat plate part 264A, the expansion modes of the second and third step floor stands and the fourth to eleventh step floor stands 10 can be changed independently. As shown in FIGS. 13C and 13D, when the movable stands are configured such that the number of lever insertion holes 66 is three in a first flat plate part 164B and two in a second flat plate part 264B, the expansion modes of the second to seventh step floor stands 10 and the eighth to eleventh step floor stands 10 can be changed independently.

Here, the mode switching unit 50 and the mode switching unit 50B are attached to the leg parts 30 facing the first flat plate parts 164A and 164B and the second flat plate parts 264A and 264B, respectively. Alternatively, the switching lever 55 may be detachable from the lever connecting plate 54, and the switching levers 55 and 55B may be replaced as appropriate.

It becomes possible to achieve expansion patterns that meet even more diverse needs of customers.

In addition to the modifications described above, the following modifications are possible.

(1) In the protruded state of the second stopper 52, the movable stands are configured such that the length of the second stopper 52 protruding in the left and right direction corresponds to the lengths of two bases 32, and the stopper rest 37 is provided on the other two bases 32 forming the same set such that, in the shortened use position, the sets of floor stands aligned in the up and down direction are configured to be in one set with three steps. That is, the set of floor stands aligned in the up and down direction in the shortened use position is not limited to two steps, but may be three or more steps.

(2) In the embodiment described above, the second stopper 52 may be attached to the lowermost step in the set of floor stands, but conversely, the second stopper 52 may be attached to the leg part of the uppermost step in the set of floor stands, and the stopper rest 37 may be attached to the base of the lowermost step behind the second stopper 52 such that the stopper rest 37 is engaged with the second stopper 52 from behind.

(3) The attachment position of the second stopper 52 is not limited to the rear end portion of the base 32, but may be the support column 31 as long as the second stopper 52 is behind the support column 31. The support column 31 may be used instead of the stopper rest 37.

It is needless to say that the number of floor stands 10, the number of connected chairs 20 disposed on one floor stand 10, the number of chairs 21 included in one connected chairs 20, the number of pairs of leg parts 30 included in one floor stand 10, and the like can be changed as necessary, regardless of the illustrated example.

REFERENCE SIGNS LIST

10: Floor stand
30: Leg part
34: First stopper
40: Fixed part
50: Mode switching unit
51: Pedestal part
52: Second stopper
53: Stopper rotating shaft
55, 55B: Switching lever
59: Tension coil spring
60, 60A, 60B: Switching drive unit
61, 61A: Fixed part
62, 62A: Movable part
64: Flat plate part
65: Linear drive device
66: Lever insertion hole
82: Swing lever
83: Fulcrum
100, 100A, 100B: Movable stands
161: First fixed part
162: First movable part
261: Second fixed part
262: Second movable part
164, 164A, 164B: First flat plate part (flat plate part of first movable part)
264, 264A, 264B: Second flat plate part (flat plate part of second movable part)
FL: Floor surface

The invention claimed is:

1. Movable stands comprising:

a plurality of floor stands; and a plurality of leg parts each horizontally supporting the floor stands and movable in a front and back direction, wherein the leg parts includes a first stopper engaged with the leg part of the floor stand that is one step below the floor stand supported by the leg part, and that allows the floor stand and the floor stand one step below to move forward in conjunction with each other to a state of being deviated in a stepped form, and a second stopper provided on the leg part of a first floor stand of a set of floor stands that includes some of the plurality of floor stands, configured to protrude toward and retracted from the leg parts of the other floor stands of the set, and engaged with the leg parts of the other floor stands to allow the floor stands of the set to move forward in conjunction while being aligned in an up and down direction, the movable stands are movable between a storage position where the floor stands are aligned in the up and down direction as a whole and a normal use position where the floor stands are expanded to a stepped form one step at a time or a shortened use position where the set of floor stands is expanded to the stepped form, the movable stands include a plurality of sets of the floor stands, in each set of floor stands, the leg parts of the first floor stand are provided with a mode switching unit that includes the second stopper and a switching lever that protrudes behind the leg parts of the first floor stand and switches the second stopper between a protruded state and a retracted state, the movable stands further include a switching drive unit fixed behind the leg parts of the plurality of floor stands aligned in a left and right direction at the storage position, and the switching drive unit is provided with a movable part that is engaged with a plurality of sets of the switching levers in the storage position, and that is configured to integrally drive a plurality of sets of the switching levers in conjunction with the driving of the movable part to switch a plurality of sets of the second stoppers between the protruded state and the retracted state.

2. The movable stands according to claim 1, wherein the mode switching unit includes a stopper rotating shaft that extends in the front and back direction, is coupled to the second stopper, and configured to be rotatable around an axis line extending in the front and back direction, and a pedestal part that rotatably supports the stopper rotating shaft, and the switching lever is coupled to the stopper rotating shaft to rotate the stopper rotating shaft, so that the switching lever is moved in the left and right direction by the driving of the movable part to switch the second stopper between the protruded state and the retracted state.

3. The movable stands according to claim 2, wherein, by a tension coil spring attached between the second stopper and the pedestal, the second stopper is biased toward a retracting direction when the second stopper is in the retracting direction further than an axis line of the tension coil spring with respect to the stopper rotating shaft, and the second stopper is biased toward a protruding direction when the second stopper is in the protruding direction further than the axis line of the tension coil spring with respect to the stopper rotating shaft.

4. The movable stands according to claim 2, wherein the movable part includes a flat plate part facing the leg parts aligned in the left and right direction in the storage position, and lever insertion holes into which the switching levers protruding rearward are inserted in the storage position are formed in the flat plate part corresponding to an interval between the switching levers, and the plurality of sets of the switching levers are moved in the left and right direction in conjunction with the movement of the movable part in the left and right direction.

5. The movable stands according to claim 1, wherein the movable part includes a flat plate part facing the leg parts aligned in the left and right direction in the storage position, and lever insertion holes into which the switching levers protruding rearward are inserted in the storage position are formed in the flat plate part corresponding to an interval between the switching levers, and the plurality of sets of the switching levers are moved in the left and right direction in conjunction with the movement of the movable part in the left and right direction.

6. The movable stands according to claim 5, wherein the movable part is movable in the left and right direction by a linear drive device provided on a fixed part.

7. The movable stands according to claim 5, wherein the movable part of the switching drive unit is coupled to a swing lever configured to be swingable in the left and right direction about a fulcrum provided on a fixed part, and is movable in the left and right direction by swinging the swing lever in the left and right direction.

8. The movable stands according to claim 5, wherein the switching drive unit includes a first fixed part, a first movable part, a second fixed part, and a second movable part, which are configured similarly to the first fixed part and the first movable part except for a length in the left and right direction and the number of lever insertion holes, the first fixed part and the first movable part are disposed to face the leg parts of some of the plurality of sets, the second fixed part and the second movable part are disposed to face the leg parts of the other sets of the plurality of sets behind the first fixed part and the first movable part, the lever insertion holes corresponding in number to the number of mode switching units facing the first movable part are formed in the flat plate part of the first movable part, the lever insertion holes corresponding in number to the number of mode switching units facing the second movable part are formed in the flat plate part of the second movable part, and the switching levers of the mode switching unit facing the second movable part have a length such that the switching levers are inserted into the lever insertion holes of the second movable part in the storage position.

9. The movable stands according to claim 8, wherein the flat plate part of the first movable part is configured to be detachable from the first movable part, the flat plate part of the second movable part is configured to be detachable from the second movable part, and the flat plate part of the first movable part and the flat plate part of the second movable part can be replaced with a flat plate part of the first movable part and a flat plate part of the second movable part each having a different combination of a number of lever insertion holes provided therein.

10. The movable stands according to claim 5, wherein, by a tension coil spring attached between the second stopper and the pedestal, the second stopper is biased toward a retracting direction when the second stopper is in the retracting direction further than an axis line of the tension coil spring with respect to the stopper rotating shaft, and the second stopper is biased toward a protruding direction when the second stopper is in the protruding direction further than the axis line of the tension coil spring with respect to the stopper rotating shaft.

11. The movable stands according to claim 10, wherein the movable part is movable in the left and right direction by a linear drive device provided on a fixed part.

12. The movable stands according to claim 11, wherein the switching drive unit includes a first fixed part, a first movable part, a second fixed part, and a second movable part, which are configured similarly to the first fixed part and the first movable part except for a length in the left and right direction and the number of lever insertion holes, the first fixed part and the first movable part are disposed to face the leg parts of some of the plurality of sets, the second fixed part and the second movable part are disposed to face the leg parts of the other sets of the plurality of sets behind the first fixed part and the first movable part, the lever insertion holes corresponding in number to the number of mode switching units facing the first movable part are formed in the flat plate part of the first movable part, the lever insertion holes corresponding in number to the number of mode switching units facing the second movable part are formed in the flat plate part of the second movable part, and the switching levers of the mode switching unit facing the second movable part have a length such that the switching levers are inserted into the lever insertion holes of the second movable part in the storage position.

13. The movable stands according to claim 10, wherein the movable part of the switching drive unit is coupled to a swing lever configured to be swingable in the left and right direction about a fulcrum provided on a fixed part, and is movable in the left and right direction by swinging the swing lever in the left and right direction.

14. The movable stands according to claim 13, wherein the switching drive unit includes a first fixed part, a first movable part, a second fixed part, and a second movable part, which are configured similarly to the first fixed part and the first movable part except for a length in the left and right direction and the number of lever insertion holes, the first fixed part and the first movable part are disposed to face the leg parts of some of the plurality of sets, the second fixed part and the second movable part are disposed to face the leg parts of the other sets of the plurality of sets behind the first fixed part and the first movable part, the lever insertion holes corresponding in number to the number of mode switching units facing the first movable part are formed in the flat plate part of the first movable part, the lever insertion holes corresponding in number to the number of mode switching units facing the second movable part are formed in the flat plate part of the second movable part, and the switching levers of the mode switching unit facing the second movable part have a length such that the switching levers are inserted into the lever insertion holes of the second movable part in the storage position.

15. The movable stands according to claim 10, wherein the switching drive unit includes a first fixed part, a first movable part, a second fixed part, and a second movable part, which are configured similarly to the first fixed part and the first movable part except for a length in the left and right direction and the number of lever insertion holes, the first fixed part and the first movable part are disposed to face the leg parts of some of the plurality of sets, the second fixed part and the second movable part are disposed to face the leg parts of the other sets of the plurality of sets behind the first fixed part and the first movable part, the lever insertion holes corresponding in number to the number of mode switching units facing the first movable part are formed in the flat plate part of the first movable part, the lever insertion holes corresponding in number to the number of mode switching units facing the second movable part are formed in the flat plate part of the second movable part, and the switching levers of the mode switching unit facing the second movable part have a length such that the switching levers are inserted into the lever insertion holes of the second movable part in the storage position.

* * * * *